US012595028B2

(12) United States Patent
Bouthillier et al.

(10) Patent No.: US 12,595,028 B2
(45) Date of Patent: Apr. 7, 2026

(54) PROTECTIVE COVER FOR ELECTRIC VEHICLE

(71) Applicant: Taiga Motors Inc., Lasalle (CA)

(72) Inventors: Philippe Bouthillier, Montreal (CA); Sergio Mora, Montreal (CA)

(73) Assignee: Taiga Motors Inc., Lasalle (CA)

( * ) Notice: Subject to any disclaimer, the term of this patent is extended or adjusted under 35 U.S.C. 154(b) by 294 days.

(21) Appl. No.: 18/131,001

(22) Filed: Apr. 5, 2023

(65) Prior Publication Data

US 2023/0322339 A1 Oct. 12, 2023

Related U.S. Application Data

(60) Provisional application No. 63/328,509, filed on Apr. 7, 2022.

(51) Int. Cl.
*B63B 59/00* (2006.01)
*B63B 34/10* (2020.01)

(52) U.S. Cl.
CPC ..... *B63B 59/00* (2013.01); *B63B 34/10* (2020.02)

(58) Field of Classification Search
CPC ..... B63B 59/00; B63B 534/10; B60J 11/04; Y02T 90/14
USPC ..... 296/136.01, 136.07; 135/88.01
See application file for complete search history.

(56) References Cited

U.S. PATENT DOCUMENTS 5,673,961 A * 10/1997 Mazzarelli ..... B60J 11/00 224/328
6,129,408 A * 10/2000 Schultz ..... B60J 11/00 296/136.04
6,918,626 B2 * 7/2005 Morin ..... B63B 17/02 296/136.01
8,075,045 B2 12/2011 Auger
8,764,097 B2 7/2014 Fournier et al.
D897,931 S * 10/2020 Guo ..... D12/402
11,001,131 B2 * 5/2021 Letendre ..... B60J 11/06

FOREIGN PATENT DOCUMENTS

CA 3 032 545 8/2020
CA 3032545 A1 * 8/2020

* cited by examiner

*Primary Examiner* — Adriana Figueroa
(74) *Attorney, Agent, or Firm* — Dicke, Billig & Czaja, PLLC

(57) ABSTRACT

One example provides a protective cover for an electric vehicle. The protective cover includes a main body to selectively fit over a body portion of the electric vehicle, including over a charging port of the electric vehicle, and includes an opening extending through the main body, the opening located so as to be proximate to the charging port when the protective cover is installed on the electric vehicle, the opening to receive and enable a charging gun to be disposed at least partially within the protective cover and be inserted into the charging port to thereby enable charging of the electric vehicle without removal of the protective cover.

20 Claims, 14 Drawing Sheets

PROTECTIVE COVER FOR ELECTRIC VEHICLE

CROSS-REFERENCE TO RELATED APPLICATIONS

This application claims priority from U.S. Provisional Patent Application No. 63/328,509, filed Apr. 7, 2022, which is incorporated by reference in its entirety herein.

TECHNICAL FIELD

The present disclosure relates generally to electric vehicles and, more particularly, to examples of a removable protective cover for electric powersport vehicles.

BACKGROUND

Due to their quiet, clean, and efficient powertrains, electric powersport vehicles (EPVs), such as, for example, snowmobiles, personal watercraft (PWC), all-terrain vehicles (ATVs), and side-by-side vehicles (SSVs), also sometimes referred to as utility task vehicles (UTVs), provide a desirable option to gas-powered vehicles for powersport enthusiasts. Electric powertrains of electric vehicles typically include a battery system, one or more electrical motors, each with a corresponding electronic power inverter (sometimes referred to as a motor controller), and various auxiliary systems (e.g., cooling systems). A battery charging port is typically disposed at a readily accessible location on the body of the vehicle.

SUMMARY

Examples of the present disclosure provide a removable protective cover for an electric powersport vehicle that provides access to a charging port of the vehicle to enable charging without a need to remove the protective cover.

One example provides a protective cover for an electric vehicle. The protective cover includes a main body to selectively fit over a body of the electric vehicle, including over a charging port of the electric vehicle, and includes an opening extending through the main body, the opening located so as to be proximate to the charging port when the protective cover is installed on the electric vehicle, the opening to receive and enable a charging gun to be disposed at least partially within the protective cover and be inserted into the charging port. In one example, a flap is disposed on an exterior surface of the protective cover and is operable between a closed position and an open position. The flap covers the opening when in the closed position and enables access to the opening when in the open position.

In one example, the flap has a distal end portion connected to the main body and an opposing proximal end portion, with the flap in the open position, the proximal end portion of the flap is configured to be secured about a perimeter of the charging gun and/or electrical cables associated with the charging gun.

In one example, the opening is adjustable between a constricted position and an expanded position to receive the charging gun.

In one example, a perimeter of the opening is biased toward the constricted position so as to be in the constricted position in the absence of the charging gun and constricts about a perimeter of the charging gun to form a weather-resistant seal about the charging gun when the charging gun is disposed therein.

In one example, the entirety of the charging gun is received within the protective cover via the opening, wherein the opening constricts about electrical cables connected to the charging gun.

In one example, the opening is elastically biased toward the constricted position.

In one example, a perimeter of the opening is movable toward the constricted position via a drawstring disposed about a perimeter.

In one example, the opening comprises an expandable slit between a pair of overlapping curtain-like flaps.

In one example, the cover comprises a transparent portion adjacent to the opening to enable viewing through the protective cover.

In one example, a transparent panel is located on the main body so as to align with and enable viewing of a display screen of a control console of the electrical vehicle when the protective cover is installed on the electric vehicle.

In one example, the cover includes a second flap operable between a closed position and an open position, the second flap covers the transparent panel when in the closed position and, when in the open position, exposes the transparent panel to enable viewing of the display panel.

In one example, the opening is formed as part of a shroud which is operable between a stowed position and a deployed position from the main body.

In one example, in the deployed position, the shroud accommodates opening and closing of a panel on the electric vehicle which covers the charging port.

In one example, the main body selectively fits over an upper body portion of the body of the electric vehicle.

In one example, the main body attaches to a bottom portion of the body of the electric vehicle.

In one example, the electric vehicle is one of a snowmobile and a personal watercraft.

One example provides a protective cover for an electric vehicle. The protective cover comprises a main body to selectively fit over at least an upper portion of the electric vehicle, including over an electric charging port of the electric vehicle. The protective cover comprises a shroud located on the main body so as to be proximate to the charging port when the protective cover is installed on the electric vehicle. The shroud is operable between a stowed position and a deployed position, the shroud including an opening accessible when in the deployed position to receive at least a portion of a charging gun through the opening to enable the charging gun to be inserted into the charging port.

In one example, a flap is disposed on the main bod. The flap is operable between a closed position and an open position to cover the shroud when in the closed position, and to enable access to the shroud when in the open position.

In one example, the flap forms a portion of the shroud, wherein operating the flap from the closed position to the open position operates the shroud from the stowed position to the deployed position. Operating the flap from the open position to the closed position operates the shroud from the deployed position to the stowed position.

In one example, the shroud is folded to have a flat configuration substantially flush with the main body when in the stowed position, and unfolded to extend beyond the exterior surface of the main body when in the deployed position, In one example, the shroud is wedge-shaped when in the deployed position and includes a pair of triangular opposing side panels, and a rectangular front panel extending between the opposing side panels. An opening is disposed in the front panel.

In one example, at least one of the opposing side panels is transparent to enable the charging port to be viewed through the shroud so as to provide visual aid to insert the charging gun into the charging port.

In one example, the shroud comprises a longitudinally extending sleeve having a first end coupled to the main body and a second end opposite the first end including the opening.

In one example, the opening is adjustable from a constricted position in the absence of the charging gun to an expanded position to receive the charging gun.

In one example, a perimeter of the opening is biased toward the constricted position such that the opening is in the constricted position in the absence of the charging gun and constricts about a perimeter of the charging when the charging gun is disposed there through.

In one example, an entirety of the charging gun is received within the shroud via the opening, and wherein the opening constricts about electrical cables extending from the charging gun.

In one example, the perimeter of the opening is elastically biased toward the constricted position.

In one example, the opening comprises a crisscross slit formed by a plurality of flaps which are elastically biased to maintain the slit in the contracted position.

In one example, the perimeter of the opening is biased toward the constricted position via a drawstring disposed about the perimeter.

In one example, the opening comprises an expandable slit between a pair of overlapping curtain-like flaps which maintain the slit in the constricted position in the absence of a charging gun, and wherein the curtain-like flaps close behind the charging gun when received within the shroud.

In one example, at least one second transparent panel is located on the main body so as to enable viewing of a display panel of a control console of the electrical vehicle when the protective cover is disposed there on.

In one example, a second flap is operable between a closed position and an open position. The second flap covers the at least one second transparent panel when in the closed position and exposes the at least one second transparent panel when in the open position to enable viewing of the display panel.

One example provides a protective cover for an electric vehicle. The protective cover comprises a main body to selectively fit over at least an upper portion of the electric vehicle, including over a charging port of the electric vehicle. The protective cover comprises a charging port access disposed on the main body so as to be located proximate to the charging port when the protective cover is installed on the electric vehicle. The charging port access includes an opening that extends through the main body. The opening receives and enables at least a portion of an electric charging gun to extend through the main body to plug into the electrical charging port. A flap is operable between a closed position and an open position, the flap covers the opening when in the closed position and enables access to the opening when in the open position.

In one example, the flap may be secured to the main body in the closed position via a fastening system.

In one example, the fastening system comprises a zipper between the flap and the main body.

In one example, a size of the opening is adjustable between a closed position, in the absence of the electric charging gun, and an open position to receive the electric charging gun.

In one example, the opening is adjustable to constrict about the electric charging gun when the electric charging gun is disposed therein.

In one example, the aperture is elastically biased toward the closed position and expandable to the open position.

In one example, the size of the opening is adjustable via a draw string disposed about a perimeter of the opening.

In one example, the opening comprises a slit formed between a pair of curtain-like flaps.

In one example a zipper is positioned between the curtain-like flaps for opening and closing the slit.

In one example, the protective cover further includes at least one first transparent panel adjacent to the opening to enable the charging port to viewed through the main body.

In one example, the protective cover further includes a display transparent panel located on the main body so as to enable viewing of a display panel of a control console of the electric vehicle when the protective cover is disposed there on.

In one example, the protective cover further includes a second flap operable between a closed position and an open position. The second flap covers the display second transparent panel when in the closed position and exposes the display transparent panel when in the open position to enable viewing of the display panel.

One example provides a protective cover for an electric vehicle. The protective cover comprises a main body to selectively fit over at least a portion of an upper body of the electric vehicle, including over an electric charging port of the electric vehicle. A shroud is located on the main body so as to be proximate to the charging port when the protective cover is installed on the electric vehicle. The shroud is operable between a stowed position and a deployed position. The shroud includes an opening accessible when in the deployed position. When in the deployed position, the shroud receives at least a portion of a charging gun through the opening to enable the charging gun to be inserted into the charging port. A flap is disposed on the main body. The flap is operable between a closed position and an open position. The flap is coupled to the shroud such that operation of the flap from the closed position to the open position operates the shroud from the stowed position to the deployed position. Operation of the flap from the open position to the closed position operates the shroud from the deployed position to the stowed position. The flap to secure to the main body and cover the shroud when in the closed position.

In one example, the shroud is folded to be substantially flush with an exterior surface of the main body when in the stowed position, and unfolded to extend beyond the exterior surface of the main body when in the deployed position.

In one example, the shroud is wedge-shaped when in the deployed position. The shroud includes a pair of triangular opposing side panels; and a rectangular front panel extending between the opposing side panels, the expandable opening disposed in the front panel, wherein lower edges of the side panels and front panel are connected to the main body and upper edges of the side panels and front panel are connected to flap such that the flap serves a lid over the shroud.

In one example, at least one of the opposing side panels is transparent to enable the charging port to be viewed through the shroud so as to provide visual aid to insert the charging gun into the charging port.

In one example, the opening is expandable from a closed position in the absence of the charging gun to an open position to receive the charging gun.

In one example, the front panel comprises a pair of curtain-like flaps which form the expandable opening as an expandable slit there between, wherein the flaps overlap to maintain the slit in the closed position in the absence of a charging gun, and close behind the charging gun when received within the shroud.

In one example, a perimeter of the opening is biased toward the closed position such that the opening is in the closed position in the absence of the charging gun and constricts about a perimeter of the charging gun when the charging gun is present.

In one example, an entirety of the charging gun is received within the shroud via the opening, wherein the opening constricts about electrical cables connected to the charging gun.

In one example, the perimeter of the opening is elastically biased toward the closed position.

In one example, the opening comprises a crisscross slit formed by a plurality of flaps which are elastically biased to maintain the slit in the closed position.

In one example, the perimeter of the opening is biased toward the closed position via a drawstring disposed about the perimeter.

In one example, at least one second transparent panel is located on the main body so as to enable viewing of a display panel of the electrical vehicle when the protective cover is disposed there on.

In one example, a second flap is operable between a closed position and an open position, the second flap to cover the at least one second transparent panel when in the closed position and to expose the at least one second transparent panel when in the open position to enable viewing of the display panel.

In one example, a storage pouch is connected to a major surface of the main body facing the electric vehicle when the protective cover is installed on the electric vehicle. An opening through the main body is selectively operable between an open position and a closed position, the opening to provide access to an interior space of the storage pouch when in the open position and through which the main body may be folded into the interior space to store the protective cover.

One example provides a protective cover for an electric vehicle. The protective cover comprises a main body to selectively fit over and cover at least a portion of the electric vehicle, including over an electric charging port of the electric vehicle. A first opening is located through the main body to be aligned with the electric charging port when the protective cover is installed on the electric vehicle. A shroud is disposed over the first opening and is operable between a stowed position and a deployed position. The shroud includes a second opening which is accessible when in the deployed position to receive at least a portion of a charging gun through the second opening to enable the charging gun to be inserted into the charging port.

In one example a flap is disposed on an exterior surface of the main body. The flap is operable between a closed position and an open position. The flap secures to the main body and cover to the shroud when in the closed position, and enables access to the shroud when in the open position.

In one example the flap forms a portion of the shroud, wherein operating the flap from the closed position to the open position operates the shroud from the stowed position to the deployed position.

One example provides a protective cover for an electric vehicle. The protective cover comprises a main body comprising a forward portion for covering at least a portion of a front body panel of the vehicle and a handlebar assembly of the vehicle. The protective cover comprises a rearward portion for covering a straddle seat of the vehicle. A shroud is located on the main body so as to be proximate to a charging port of the vehicle when the protective cover is installed on the electric vehicle. The shroud is operable between a stowed position and a deployed position. The shroud includes an opening accessible when in the deployed position to receive at least a portion of a charging gun through the opening to enable the charging gun to be inserted into the charging port.

Additional and/or alternative features and aspects of examples of the present technology will become apparent from the following description and the accompanying drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

Electric powersport vehicles (EPVs), such as snowmobiles, personal watercraft (PWC), all-terrain vehicles (ATVs), and side-by-side vehicles (SSVs), for example, offer powersport enthusiasts a quiet, clean, and more environmentally friendly option to gas-powered vehicles. Electric vehicles have electric powertrains which typically include a battery system, one or more electrical motors, each with a corresponding electronic power inverter (sometimes referred to as a motor controller), and various auxiliary systems (e.g., cooling systems). A battery charging port is typically disposed at a readily accessible location on the body of the vehicle, where such charging ports may include a DC receptacle for connecting to a DC charging source and/or an AC receptacle for connecting to an AC power source.

When not in use, such as when being stored or transported, EPV's may be covered with a removable protective cover to protect against natural elements (e.g., sun, snow, rain, dirt/dust) and road debris (e.g., dirt, oil, rocks). During such times, it may be desirable to charge an EPV's batteries. However, it is generally inconvenient to remove and reinstall the protect cover to facilitate such charging.

As will be described in greater detail herein, the present disclosure provides examples of a removable protective cover for EPVs that facilitates charging of the vehicle's batteries without requiring removal of the protective cover. In examples, the protective cover includes an adjustable opening that is aligned with, or in proximity to, a charging port of an EPV when the cover is installed thereon, wherein the opening receives and enables a charging gun to be plugged into the charging port receptacle while also shrouding the charging gun and interior of the protective cover from the environment during the charging process.

Figure 1A:
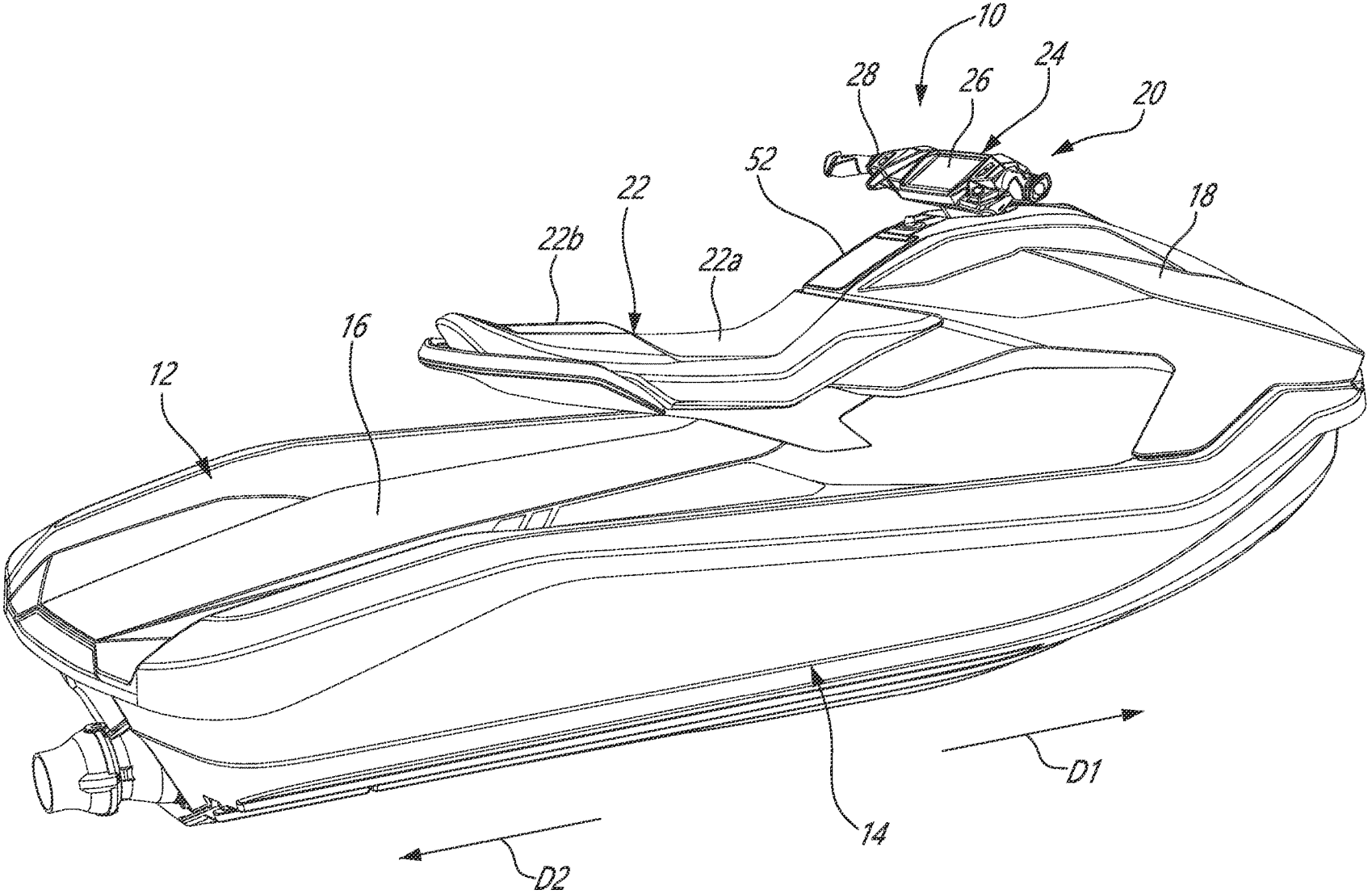
FIG. 1A is a perspective view generally illustrating an electric vehicle, in particular, a personal watercraft, suitable for use with a removable protective cover in accordance with the present disclosure.
Figure 1B:
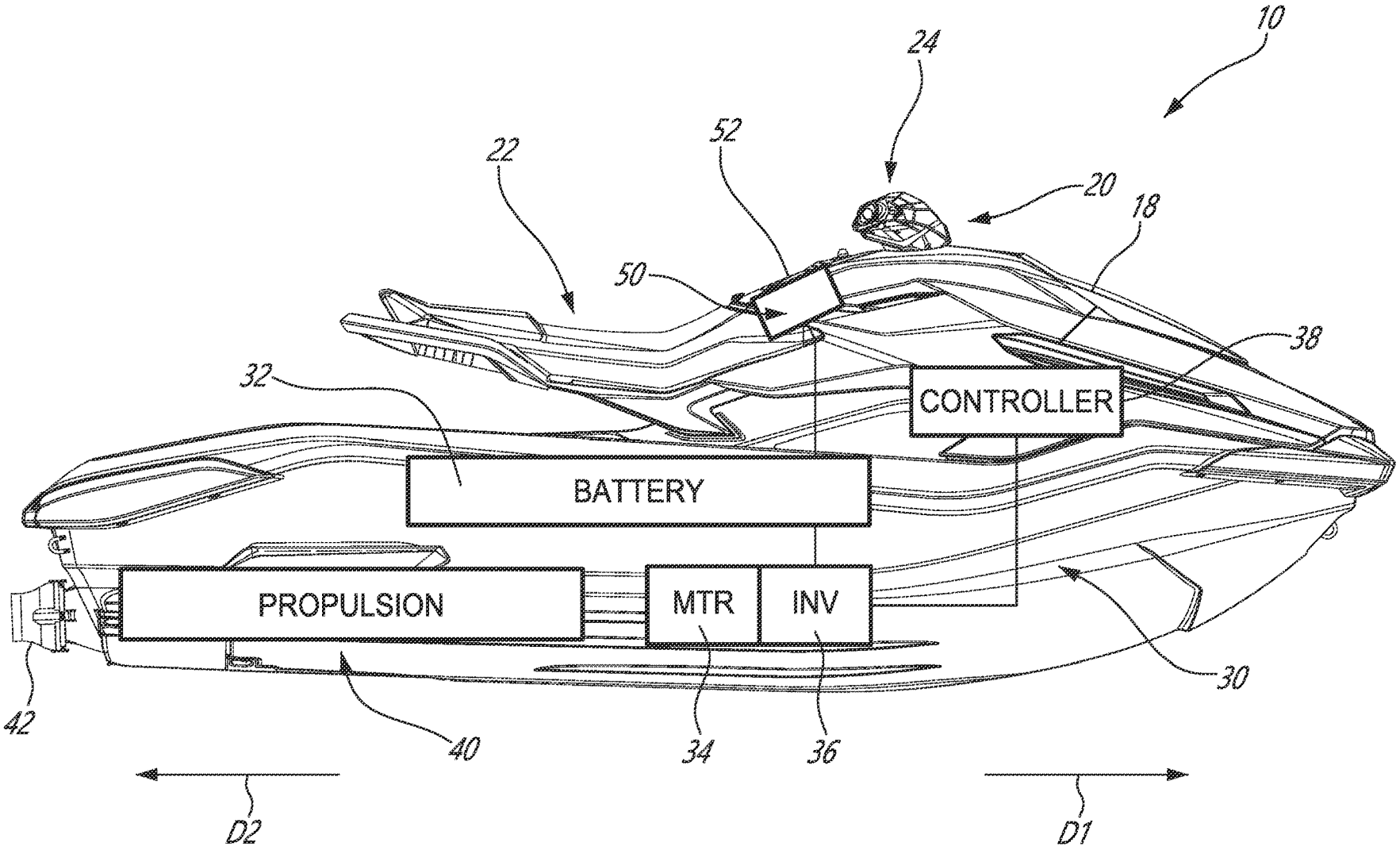
FIG. 1B is a side view generally illustrating an electric vehicle, in particular, a personal watercraft, suitable for use with a removable protective cover in accordance with the present disclosure.

FIGS. 1A and 1B are perspective and side views generally illustrating an EPV 10, in this case, an electric personal watercraft (PWC) 10, suitable for use with a removable protective cover, according to examples of the present disclosure (which will be described in greater detail below). Although illustrated as a PWC 10, it is noted that examples of a removable protective cover described herein may be adapted for use with other types of electric vehicles, including automotive electric vehicles (e.g. electric cars) and various EPVs such as, for example, snowmobiles, ATVs, UTVs, and electric motorcycles.

In examples, PWC 10 includes a vehicle body made of a deck body 12 coupled in a sealed fashion to a hull 14. The deck body 12 generally defines an upper body portion of the vehicle body and the hull 14 generally defines a bottom portion of the vehicle body. In some examples, upper body portion of the vehicle body generally faces skyward when the vehicle is positioned upright, and the bottom body portion generally faces groundward when the vehicle is positioned upright. In an example of PWC 10, the deck body 12 defines a rear platform 16 which enables users to board from the water via the rear of the watercraft. Deck body 12 further defines a raised forward body 18 supporting a steering assembly 20 and a cantilevered straddle seat 22 extending in a rearward direction D2 (opposite a forward direction D1) over rear platform 16 and defining operator and passenger positions 22*a* and 22*b*. The raised forward body 18 may comprise one or more body panels, and a hatch door (not shown) providing access to a front storage area. In examples, steering assembly 20 includes a control console 24 having handlebar button clusters (not shown) and an externally visible display device 26 to display information to an operator (e.g., a driver of PWC 10), such as operational information (e.g. speed, vehicle mode, state of charge, etc.). In one example, display device 26 comprises a digital display screen 26, such as a liquid crystal display (LCD), light emitting diode display (LED), plasma (PDP) display, and a quantum dot (QLED) display, for example. In examples, control console 24 is mounted to and pivots together with a handlebar assembly 28 of steering assembly 20. In examples, steering assembly 20 and/or control console 24 include a plurality of control mechanisms (such as button clusters, not illustrated) for controlling operation of PWC 10 (e.g., a throttle, trim control).

In examples, PWC 10 has an electric power train 30 including a battery pack 32 to power an electric motor 34 via a corresponding electronic motor controller 36 (also sometimes referred to as an inverter). Motor 34 may be drivingly coupled to propulsion system 40 in a speed-transmitting or torque-transmitting engagement. In various embodiments, motor 34 may be a permanent magnet synchronous motor or a brushless direct current motor for example. In some examples, motor 34 may have a power output rating of between 90 and 180 horsepower, or motor 34 may have a maximum output power rating of greater than 180 horsepower, for example.

In the example of PWC 10, the propulsion system is a jet propulsion system 40 driven by electric motor 34 that ejects a pressurized jet of water through a pivoting steering nozzle 42 which is controlled by a driver via a steering assembly 20 to provide a directionally controllable jet of water to propel and steer PWC 10. In some examples, steering nozzle 42 may be directed upward and downward to provide trim control to PWC 10. In examples, a trim angle of steering nozzle 42 may be controlled by a driver via inputs on control console 24.

In examples, electronic motor controller 36 converts DC power from battery pack 32 to AC power to drive electric motor 34. In examples, the operation of electric motor 34 and the delivery of power to electric motor 34 from battery pack 32 via electronic motor controller 36 is controlled by a controller 38. In examples controller 38 is operable to control delivery of electrical power from battery pack 32 to electric motor 34 via electronic motor controller 36 through control of a drive current as a function of one or more input devices, such as a throttle on control console 24. In examples, based on inputs, such as from control console 24, controller 38 is operable to control a torque or rotational speed of electric motor 34 so as to control a thrust generated by propulsion system 40 to propel PWC 10.

In one example, battery pack 32 includes a number of battery modules, with each battery module including a number of electrically interconnected battery cells, where the battery modules are, in turn, electrically connected with one another to form battery pack 32. In some examples, battery pack 32 provides a high voltage output, such as in the range of 300-400 VDC, and in some cases 800 VDC. In examples, each battery cell comprises a lithium-ion battery cell, although any number of other suitable battery chemistries and configurations may be employed.

In examples, PWC 10 includes an electric charging port 50 disposed on an elevated front body 18 portion between steering assembly 20 and straddle seat 22. In other examples, electric charging port 50 may be located forwardly of the steering assembly 20. In still other examples, the electric charging port 50 may be located rearwardly of the straddle seat 22. In examples, electric charging port 50 is disposed along a longitudinal axis of the electric vehicle, substantially mid-way between the left and right side of the vehicle. In other examples, the electric charging port 50 may be located on either a left or right side portion of the vehicle (e.g. in automotive electric vehicles, the electric charging port 50 may be accessed through a body panel on a side portion of the electric vehicle). In other examples, it is noted that charging port 50 may be disposed at any number of other locations. In one example, as illustrated, a hinged port cover 52 is operable between a closed position, to cover charging port 50 when not in use, and an open position, to provide access to charging port 50 for charging of battery pack 32.

Figure 2:
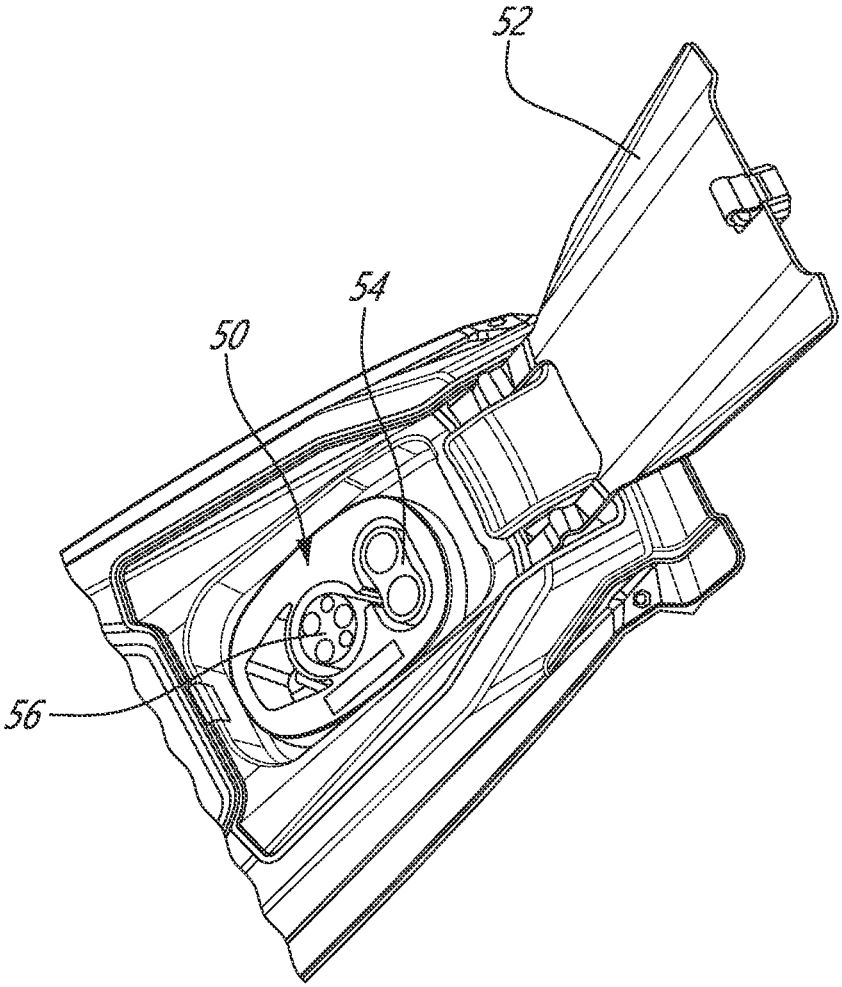
FIG. 2 is an enlarged perspective view generally illustrating a charging port, according to one example.

FIG. 2 is a perspective view of a portion of PWC 10 illustrating charging port 50, according to one example, with port cover 52 in the open position. In one example, as illustrated, charging port 50 includes a DC charging receptacle 54 to receive a charging gun of an external DC charging source, and an AC charging receptacle 56, such as an J1772 connector, to receive a plug of an external AC power source.

Figure 3:
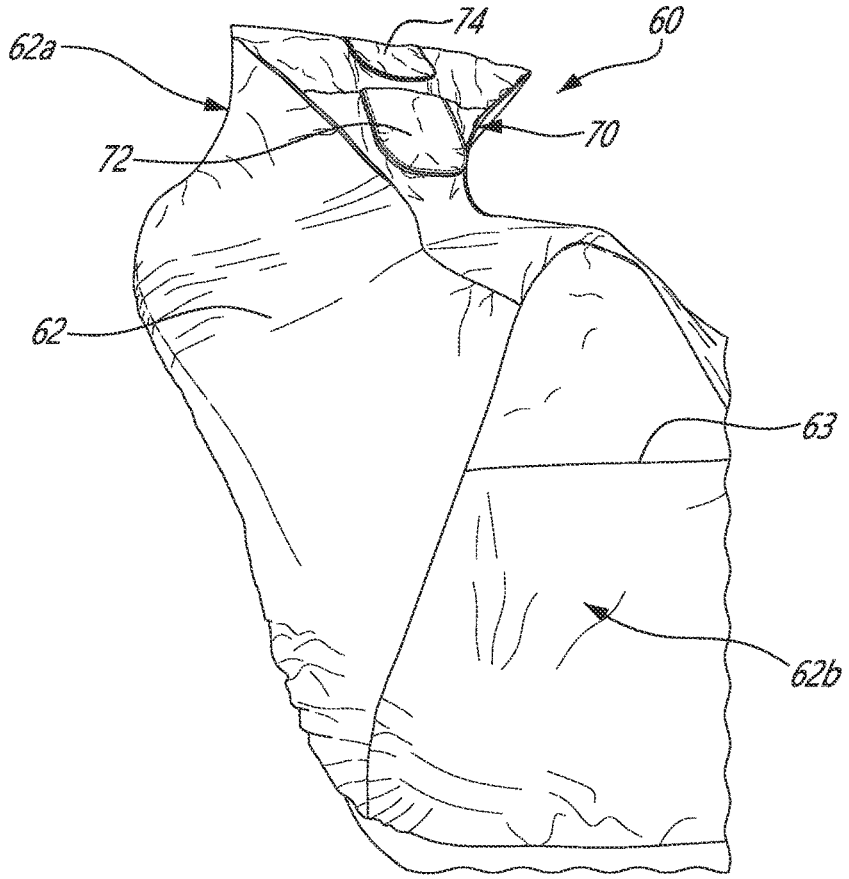
FIG. 3 is a rear perspective view generally illustrating a removable protective cover including a charging port access, according to examples of the present disclosure.

FIG. 3 is a perspective view of PWC 10 illustrating a removable protective cover 60, according to one example of the present disclosure, installed thereon. In one example, as illustrated, removable protective cover 60 includes a main body 62 selectively fitted over a portion of the vehicle body of the PWC 10. In one example, removable protective cover 60 is securely fitted over an upper body portion of the vehicle body. In one example, as illustrated, removable protective cover 60 is selectively fitted over deck body 12, including over rear platform 16, raised forward body 18, and straddle seat 22, as well as over steering assembly 20 and control console 24. In one example, main body 62 comprises a forward portion 62*a* for covering a forward portion of the vehicle, including at least a portion of one or more front body panels, the handlebar assembly 28 and the control panel/display screen 26. The main body 62 further comprises a rearward portion 62*b* for covering a rearward portion of the vehicle, including the straddle seat 22 and the rear platform 16. In one example, removable protective cover 60 further covers a portion of the bottom portion of the vehicle body, such that it descends down over a portion of the hull 14. In other examples, main body 62 may be configured to cover more or less of PWC 10. In some examples, the main body 62 of the cover 60 may attach to the bottom portion of the electric vehicle, such as via straps, clips or any other known attachment mechanism.

In examples, main body 62 is made of a pliable, water-resistant material, such as a polyester material, for example. In examples, in addition to being water-resistant, the material of main body 62 may be selected with properties to provide resistance against any number of environmental elements (such as heat, sun, wind, cold temperatures, etc.). In addition to a polyester material, main body 62 may be made of any number of other suitable materials (e.g., nylon, neoprene, or cotton), or combinations thereof. When not installed on PWC 10, protective cover 60 may be folded for storage. In some examples, as will be further described in relation to FIGS. 12*a* and 12*b*, protective cover 60 may comprise a built-in storage pouch accessible via selectively closeable opening 63 (e.g., zippered) in main body 62, and into which main body 62 of protective cover 60 can be inserted for storage. In accordance with the present disclosure, protective cover 60 includes a charging port access 70 disposed on main body 62 and located proximate to (e.g., aligned with) the electric charging port 50 of the PWC 10 when protective cover 60 is installed thereon.

Figure 4:
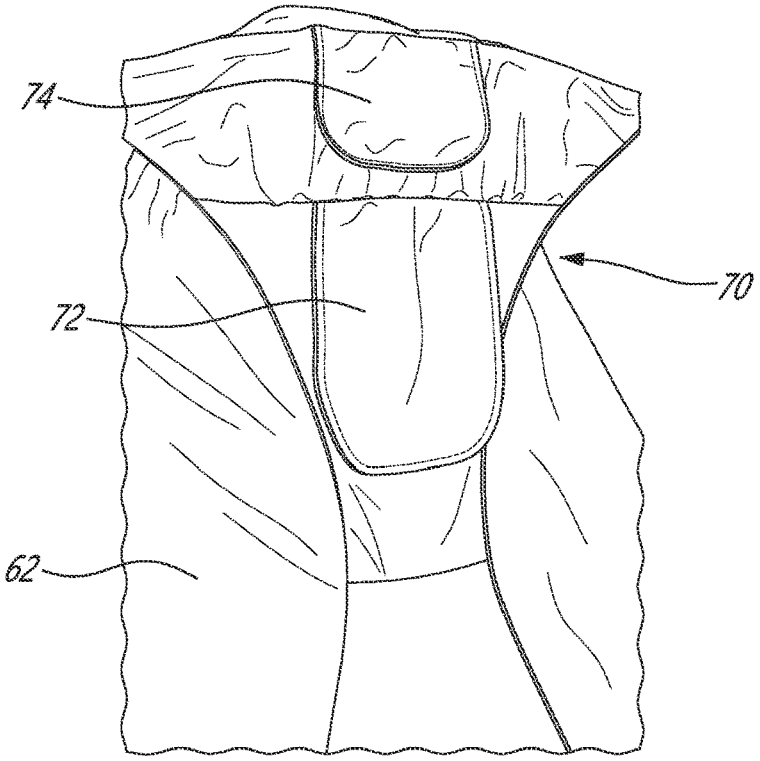
FIG. 4 is a perspective view generally illustrating portions of a removable protective cover including a charging port access shown in a stowed position, according to examples of the present disclosure.

FIG. 4 is an enlarged perspective view of a portion of protective cover 60 of FIG. 3 illustrating charging port access 70 in greater detail. In one example, charging port access 70 includes a flap 72 operable between a closed position and an open position where, in the closed position (such as illustrated by FIGS. 3 and 4), flap 72 provides a weather-resistant cover over an opening through main body 62 where, as will be described in greater detail below (e.g., see FIGS. 9A-9D), such opening provides access to charging port 50 and port cover 52 to enable charging of PWC 10 without removal of protective cover 60. In one example, as illustrated by FIG. 4, charging port access 70 further includes a second flap 74 operable between a closed position and an open position where, in the closed position (such as illustrated by FIGS. 3 and 4), second flap 74 provides a weather-resistant cover over a transparent panel where, as will be described in greater detail below (e.g., see FIGS. 10A-10B), such transparent panel enables viewing of display screen 26 of control console 24 to monitor a charging status of battery pack 32 as well as other vehicle information. It is noted that flap 72 may sometimes be referred to herein as first flap 72. In examples, when in the closed position, first and second flaps 72 and 74 may be secured to the exterior surface of main body 62 using any number of suitable techniques, such as a hook-and-loop system, snaps, magnets, clips, and zippers, for example.

Figure 5:
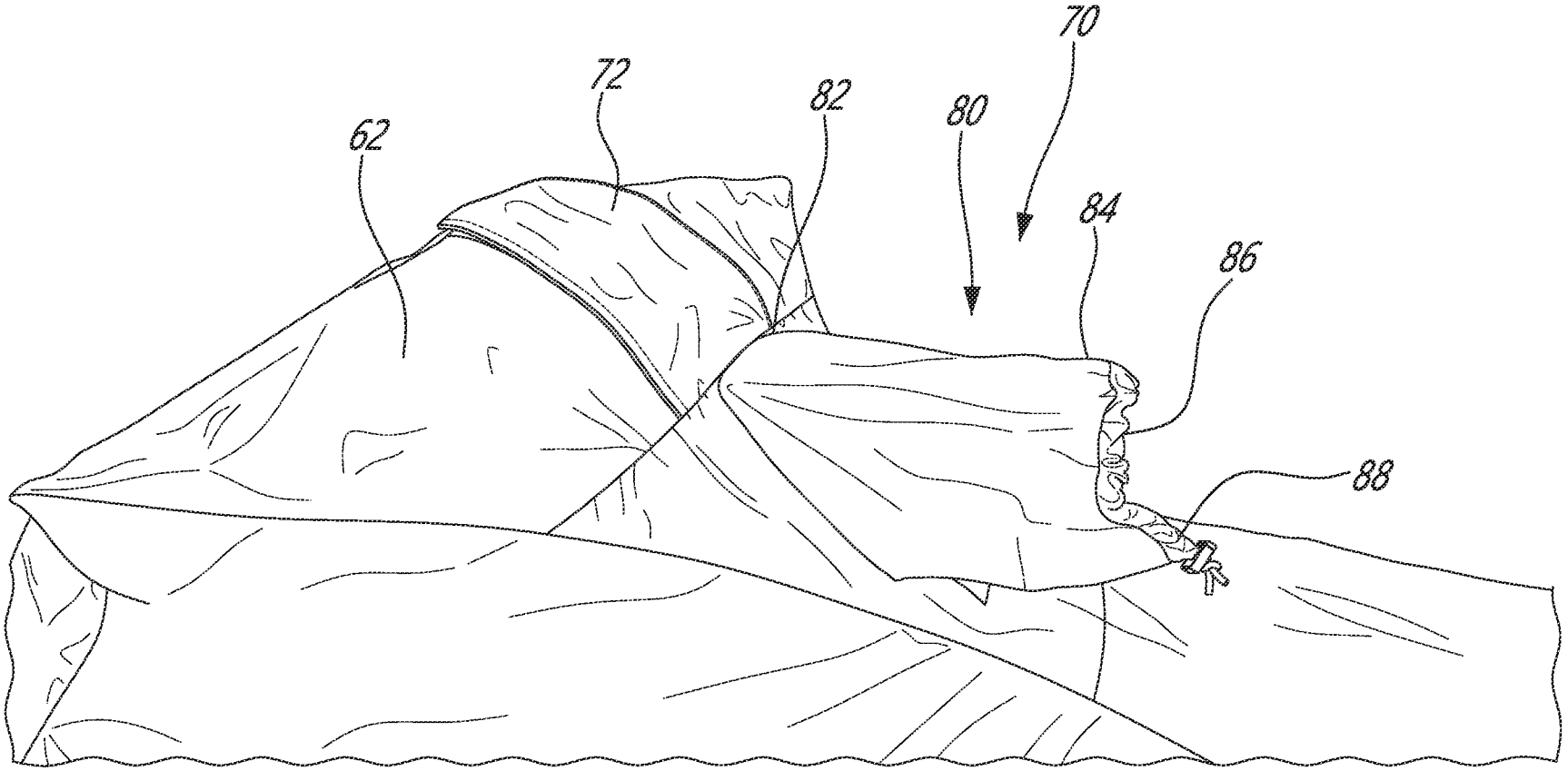
FIG. 5 is a perspective view generally illustrating portions of a removable protective cover including a charging port access shown in a deployed position, according to examples of the present disclosure.

FIG. 5 is an enlarged perspective view of one example of a portion of protective cover 60 of FIG. 3 illustrating charging port access 70 in greater detail, where flap 72 is shown in the open position. In one example, with flap 72 in the open position, a shroud 80 of charging port access 70 is accessible, where shroud 80 is operable between a stowed position and a deployed position. In one example, as illustrated, shroud 80 has a sleeve-like configuration extending from a distal end portion 82 connected to main body 62 to an opposing proximal end portion 84 which is free from main body 62 and which defines an adjustable opening 86. When in the deployed position, as illustrated by FIG. 5, shroud 80 extends from main body 62 and, via adjustable opening 86, provides a passageway to access charging port 50 and port cover 52. In examples, an interior space of shroud 80 receives port cover 52 when in the open position.

In some examples, when in the open position, port cover 52 may assist with maintaining shroud 80 in the deployed position.

When in the deployed position, shroud 80, via adjustable opening 86, is configured to receive at least a portion of a charging gun from an external power source, such as a DC charging gun of an external DC charging system (e.g., see FIG. 9D below) or an AC charging gun from an external AC power source, and enable the charging gun to be inserted into the corresponding receptacle of charging port 50 (e.g., DC receptacle 54 or AC receptacle 56). In examples, sleeve-like shroud 80 may include a stiffening member to assist in maintaining shroud 80 in the open position.

In examples, a perimeter of adjustable opening 86 is expandable to enable access to charging port 50 and port cover 52 through shroud 80 and thereby enable the opening of port cover 52 and the insertion of the external charging gun into charging port 50. In examples, with the external charging gun inserted within charging port 50, a perimeter of adjustable opening 86 constricts about a perimeter of the charging gun, or charging gun cabling, to form a weather-resistant seal thereabout. In some examples, shroud 80 is configured to receive an entirety of the external charging gun therein such that adjustable opening 86 constricts and forms an weather-resistant seal about electrical cable(s) extending from the external charging gun. In some examples, a size of adjustable opening 86 is adjusted via an adjustable draw-string 88 disposed about the perimeter of adjustable opening 86. In other examples, adjustable opening 86 may be elastically biased toward a closed or constricted position. In other examples, a size of adjustable opening 86 may be adjusted via adjustment of a hook-and-loop configuration. In other examples, a size of adjustable opening 86 may be adjusted via adjustment of a single or double zip arrangement. Any number of suitable techniques may be employed to provide adjustment of the size of adjustable opening 86.

In examples, when in the stowed position, shroud 80 is folded down to a retracted configuration to enable first flap 72 to cover shroud 80. In one example, first flap 72 forms a weather-resistant seal about shroud 80 when in the closed position (such as illustrated by FIGS. 3 and 4, for example). In one example, a perimeter edge of first flap 72 is secured to the exterior surface of main body 62 of protective cover 60 via a hook-and-loop type fastening system. In other examples, shroud 80 may be folded, rolled, scrunched and/or tucked inside main body 62 prior to closing first flap 72.

Figure 6A:
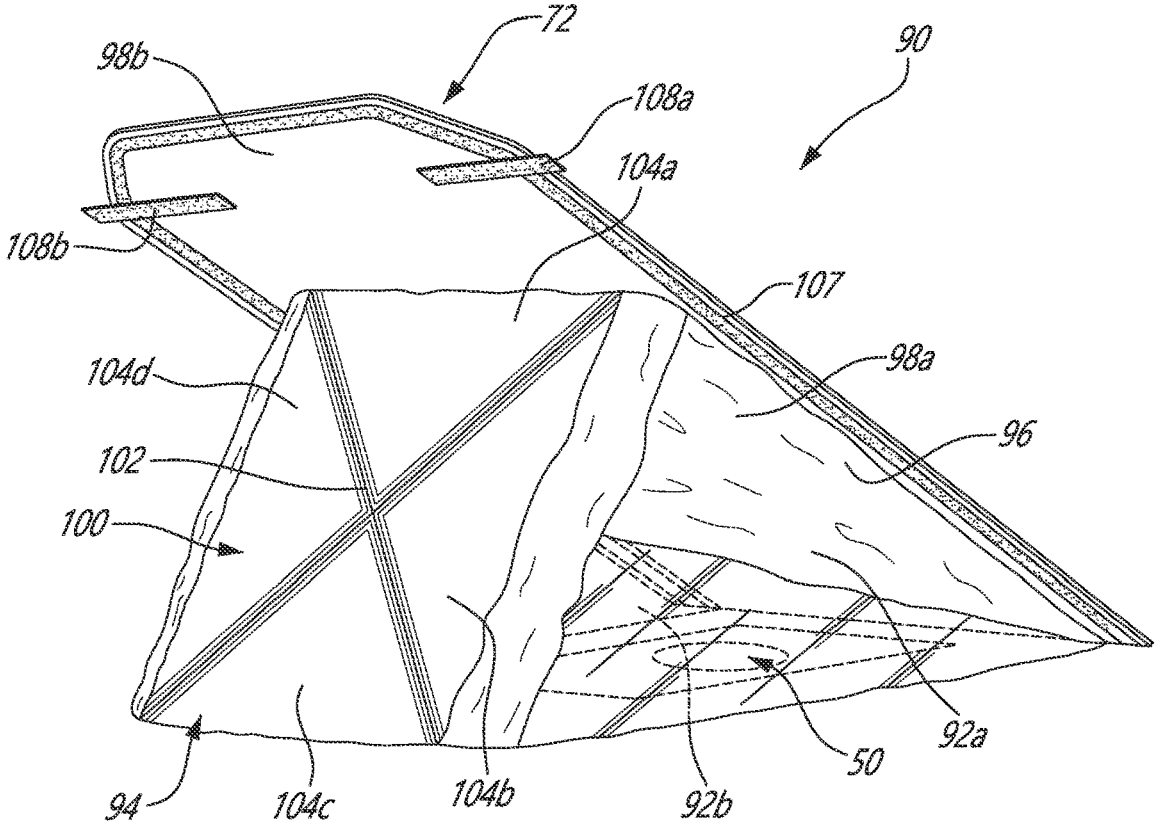
FIG. 6A is a perspective view generally illustrating a shroud of a charging port access of a removable protective cover in a deployed position, according to examples of the present disclosure.

As illustrated by the FIG. 6A, according to one example, in lieu of sleeve-like shroud 80 of FIG. 5, charging port access 70 includes a wedge-shaped shroud 90 which is operable between a stowed position and a deployed position. It is noted that wedge-shaped shroud 90 is illustrated in the deployed position by the schematic diagram of FIG. 6A. In examples, wedge-shaped shroud 90 includes a pair of opposing side panels 92*a* and 92*b* (e.g. which may be substantially triangular in shape) and a front panel 94 (e.g. which may be substantially rectangular in shape) that extends between front edges of side panels 92*a*/92*b* and forms a front face 95 of shroud 90. A top panel 96 extends between top edges of side panels 92*a*/92*b* and a top edge of front panel 94. In examples, bottom edges of side panels 92*a* and 92*b*, front panel 94, and top panel 96 are joined to main body 62. In one example, top panel 96 is part of first flap 72, such that the first flap 72 is incorporated as part of shroud 90. In such an example, first flap 72 comprises a first portion 98*a* forming top panel 96 and a second portion 98*b* extending beyond front panel 94 and side panels 92*a*/92*b*. In examples, such as illustrated below by FIGS. 9A-9D, second portion 98*b* can be engaged by a user to operate first flap 72 between the closed and open positions, where operation of first flap 72 operates shroud 90 between the stowed and deployed positions.

In examples, front panel 94 includes an adjustable opening 100 to provide access to an interior of wedge-shaped shroud 90 which, in turn, forms a passageway through main body 62 to provide access to charging port 50 without requiring removal of protective cover 60 from PWC 10. In examples, such as illustrated by FIGS. 9A-9D below, when in the deployed position, shroud 90 is to receive at least a portion of an external charging gun via expandable opening 100 and enable the charging gun to be inserted into the corresponding receptacle (e.g., DC receptacle 56 or AC receptacle 58) of charging port 50 for charging of battery pack 32 of PWC 10. In examples, one or both of the opposing side panels 92*a*, 92*b*, or portions thereof, are formed of a transparent material to enable visual assistance when opening port cover 52 and inserting an external charging gun into charging port 50. It is noted that the interior space of shroud 90 is configured to receive and accommodate hinged port cover 62 when in the open position.

Figure 6B:
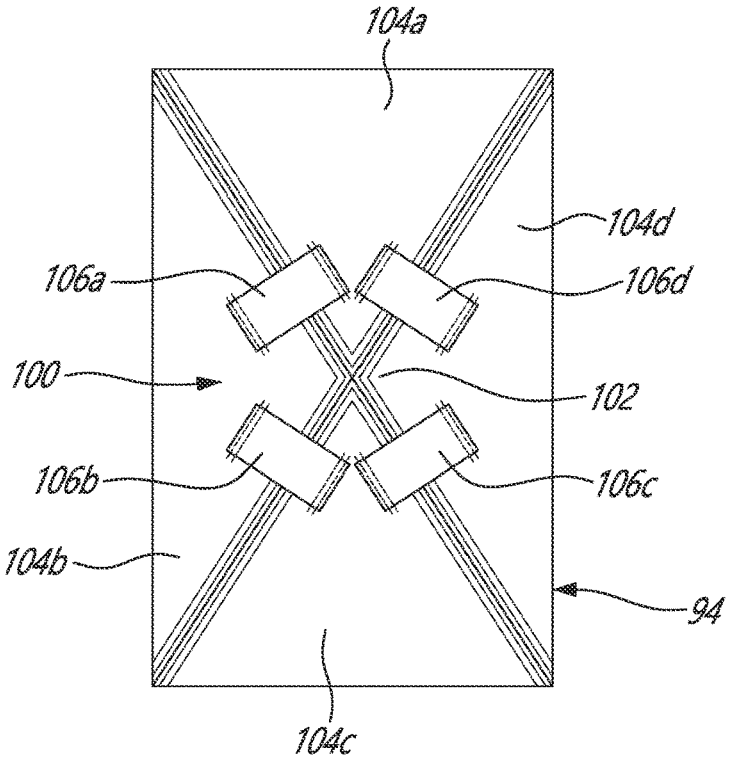
FIG. 6B is a rear view of a front panel of a shroud of a charging port access of a removable protective cover, according to examples of the present disclosure.

As illustrated by FIG. 6A, in one example, expandable opening 100 comprises a crisscross slit 102 (e.g., an X-shaped slit) through front panel 94 formed by a plurality of flaps 104, such as flaps 104*a*-104*d*. In examples, the plurality of flaps 104 are elastically biased to maintain crisscross slit 102 in a normally closed position, and to bias flaps 104 against a perimeter of an external charging gun (e.g., about a body of a charging gun or about electric cables extending from a charging gun) when disposed within shroud 90. With reference to FIG. 6B, which is a diagram illustrating a back side of front panel 94, a number of elastic strips 106, such as elastic strips 106*a*-106*d*, join a portion of a length of abutting edges of flaps 104*a*-104*d*, where elastic straps 106 bias flaps 104*a*-104*d* to maintain crisscross slit 102 in a normally closed position, and are spaced from a center of slit 102 to enable slit 102 to expand and allow a charging gun (or other object, such as a user's hand, for example) to be inserted there through while maintaining an weather-resistant seal there about.

In examples, a fastener 107 is disposed along at least a portion of a perimeter edge of first flap 72 (e.g. along a perimeter edge of second portion 98*b* of first flab 72) to enable the first flap 72 to be secured to the exterior surface of main body 62 of protective cover 60 so as to form an weather-resistant seal about shroud 90, including about opening 100 (e.g., crisscross opening 102) when shroud 90 is in the stowed position (see, for example, FIG. 9A and FIGS. 11A-11C). In one example, fastener 107 comprises a portion of a hook-and-loop type fastening system wherein a corresponding fastener is disposed in an aligned fashion on the exterior surface of main body 62. In one example, fastener 107 comprises half of a zip, and a corresponding half of the zip is disposed in an aligned fashion on the exterior surface of the main body 62. In one example, first flap 72 includes a second fastener system 108, illustrated as fasteners 108*a* and 108*b*, which enables second portion 98*b* of first flap 72 to wrap around and be secured about a portion of a charging gun (e.g., about electrical cables extending from a charging gun) when inserted within shroud 90 via opening 100. In one example, fasteners 108*a* and 108*b* may be hook-and-loop type fasteners that can be secured to one another when second portion 98*b* of first flap 72 is wrapped around electrical cables of a charging gun.

Figure 7A:
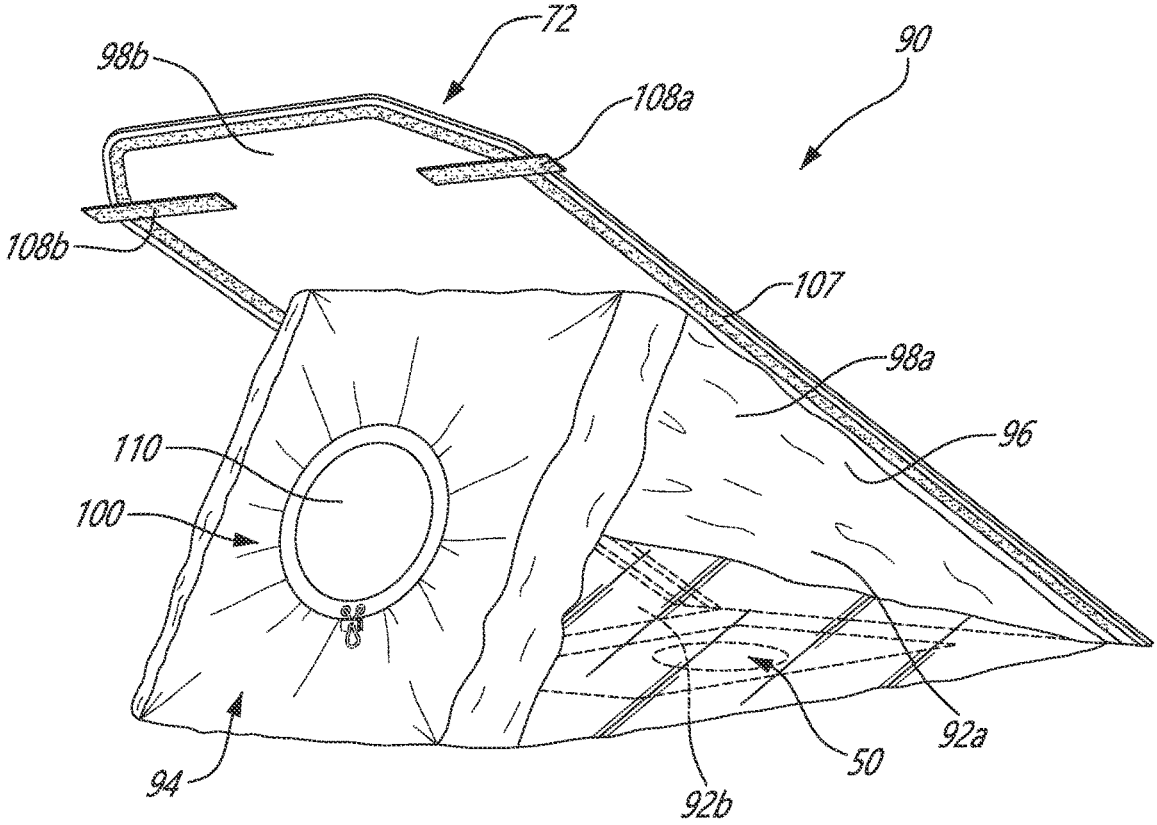
FIG. 7A is a perspective view generally illustrating a shroud of a charging port access of a removable protective cover in a deployed position, according to examples of the present disclosure.
Figure 7B:
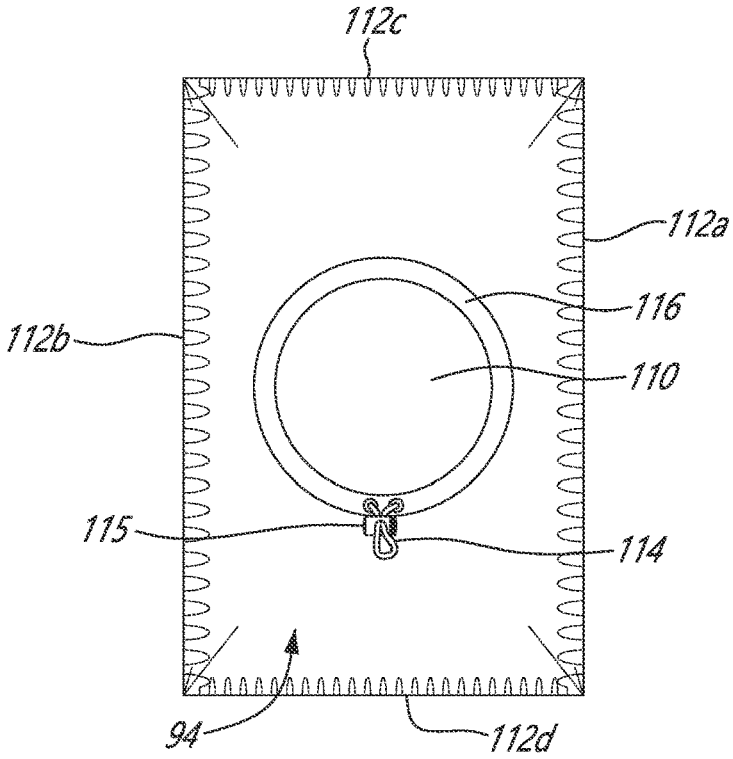
FIG. 7B is a front view of a front panel of a shroud of a charging port access of a removable protective cover, according to examples of the present disclosure.

As illustrated by FIGS. 7A and 7B, according to one example, in lieu a crisscross opening, opening 100 through front panel 94 comprises an adjustable circular opening 110. In one example, front panel 94 comprises an elastic stretch panel which is sewn in a gathered fashion (as illustrated by the scalloped lines) to side panels 92*a*/92*b* along perimeter side edges 112*a* and 112*b*, to first flap 72 along upper perimeter edge 112*c*, and to main body 62 along lower perimeter edge 112*d*, to enable opening 110 to expand and constrict in size. In one example, a drawstring 114 is disposed with a loop 116 about a perimeter of circular opening 110 where drawstring 114 can be pulled to constrict circular opening 110 about a perimeter of charging gun components (including charging gun wires or cables) when a charging gun is disposed within shroud 90 so as to form an weather-resistant seal there about, or to close circular opening 110 when not in use. In one example, drawstring 114 comprises an elastic cord. In one example, drawstring 114 includes a mechanism 115 for securing drawstring 114 at a selected length.

Figure 8:
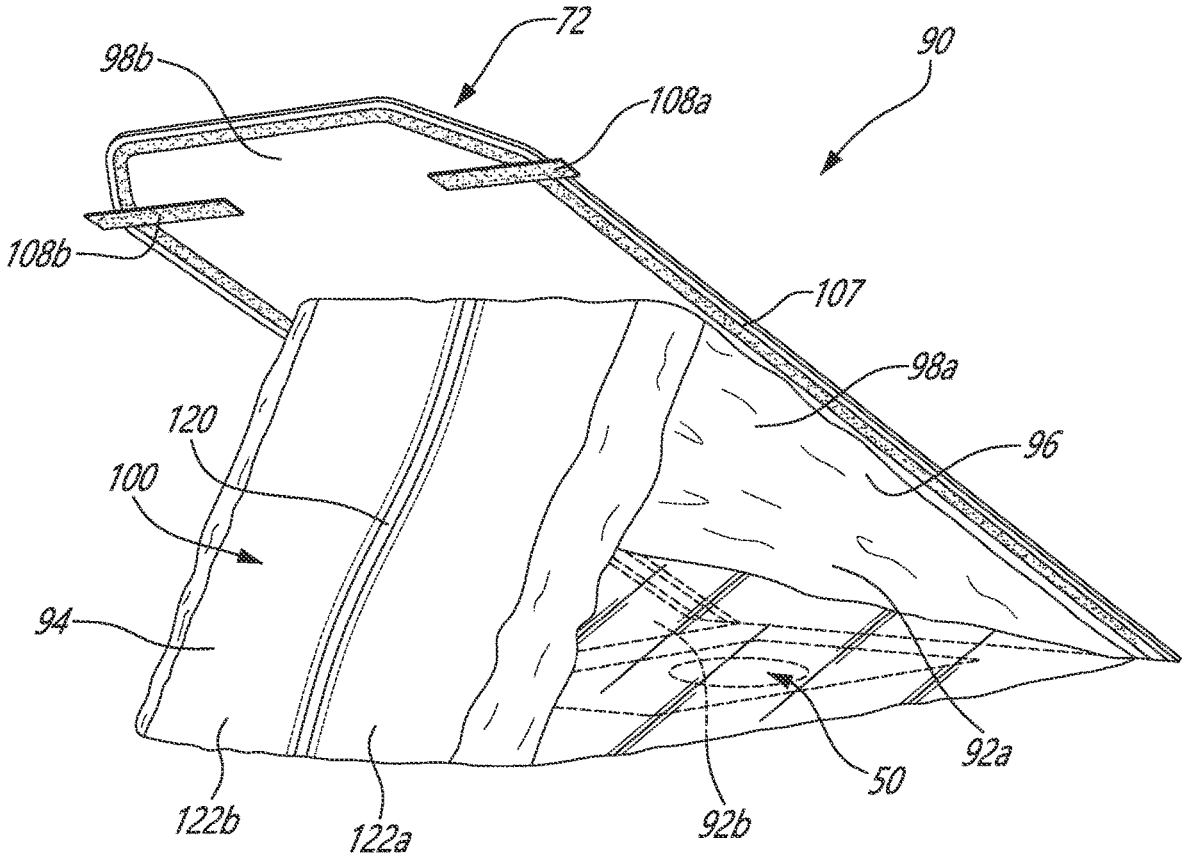
FIG. 8 is a perspective view generally illustrating a shroud of a charging port access of a removable protective cover in a deployed position, according to examples of the present disclosure.

As illustrated by FIG. 8, according to one example, opening 100 through front panel 94 comprises an expandable slit 120 formed by a pair of curtain-like flaps 122*a* and 122*b* which together form front panel 94. In one example, expandable slit 120 may be elastically biased to a normally closed position, such as by employing elastic strips disposed on a backside of front panel 94 which join flaps 122*a* and 112*b* together across slit 120 in a fashion similar to elastic strips 106 of FIG. 6B. In one example, expandable slit may be closable via hook and loop fasteners, one or more zips (or zippers), snaps, magnets, or any other suitable closing mechanism.

It is noted that crisscross opening 102, circular opening 110, and curtain-like slit 120 are included as examples of openings 100 through front panel 94 of shroud 90, and that any number of suitable openings may be employed in addition to those explicitly illustrated herein.

FIGS. 9A through 9D generally illustrate an example of the operation of charging port access 70, where charging port access 70 includes first flap 72 and wedge-shaped shroud 90 employing adjustable circular opening 110 as illustrated by the example implementation of FIGS. 7A and 7B. It is to be understood that any other example implementation could also have been described. In the illustrated example of FIGS. 9A to 9D, it is noted that charging port access 70 further includes optional second flap 74 covering a transparent panel for viewing display screen 26 of control console 24 of the electric vehicle. In one example second flap 74 provides an opening to the vehicle without a transparent viewing panel, such that direct access is provided to the display screen 26.

Figure 9A:
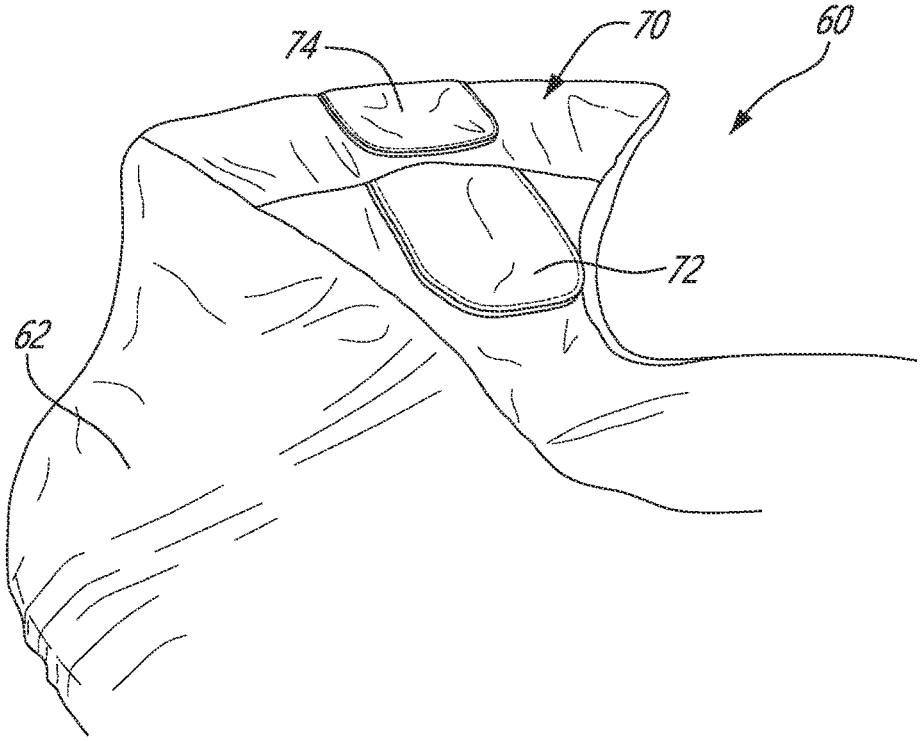
FIGS. 9A-9D are perspective views generally illustrating operation of a charging port access of a removable protective cover, according to examples of the present disclosure.
Figure 9B:
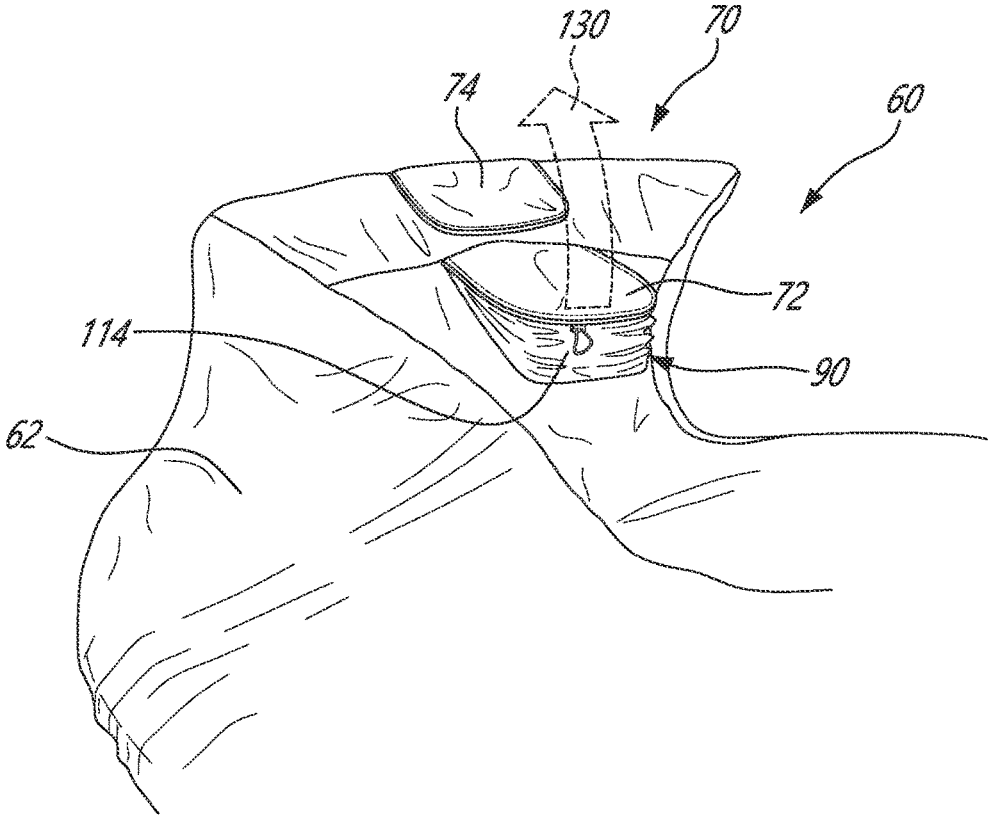

Beginning at FIG. 9A, both first and second flaps 72 and 74 are in a closed position and secured to the exterior surface of main body 62. At FIG. 9B, first flap 72 is illustrated as being partially pivoted or moved toward the open position (in a direction indicated by arrow 130). With first flap 72 connected to wedge-shaped shroud 90, as first flap 72 is moved toward the open position, shroud 90 begins to move from a stowed position (where it is folded in a flat or scrunched position below first flap 72) and, as illustrated by FIG. 9B, begins to extend from main body 62. In FIG. 9B, portions of shroud 90 are exposed, including a portion of drawstring 114.

Figure 9C:
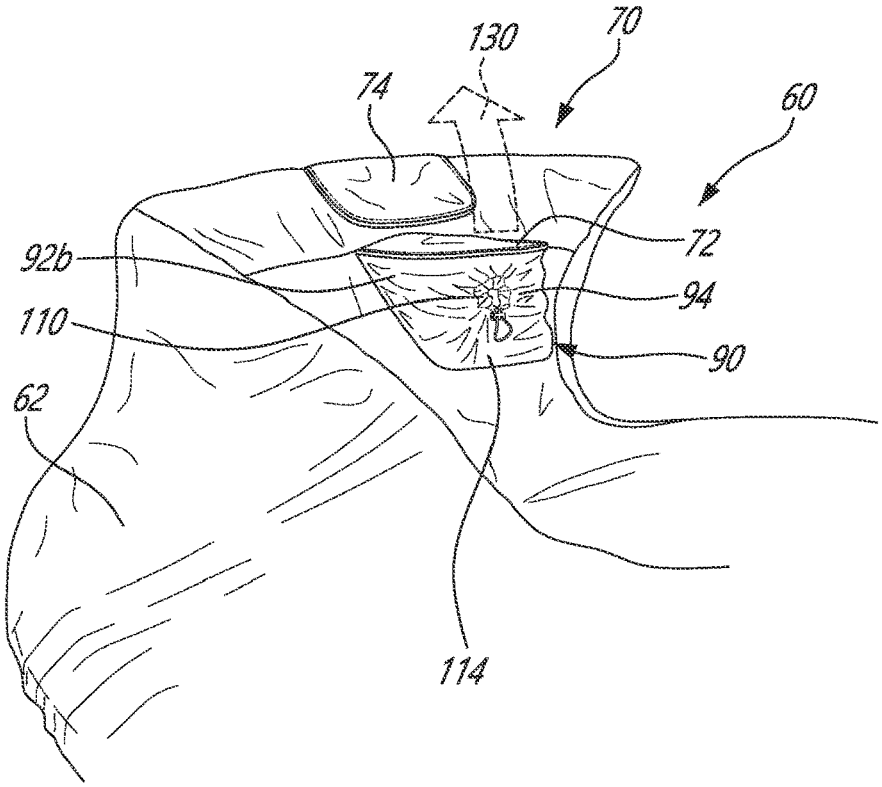

At FIG. 9C, as first flap 72 is pivoted or moved to a fully open position, as indicated by directional arrow 130, wedge-shaped shroud 90 moves to the fully deployed position where front panel 94, along with circular opening 110 (which is shown in a closed or constricted position) and drawstring 114, are exposed. In one example, a user is now able to expand circular opening 110 by releasing a tension of drawstring 114, at which point the user can reach into and through shroud 90 to upwardly pivot access door 52 (which is illustrated by FIGS. 1A, 1B, and 1C) to an open position to expose charging port 50, where, opened access door 52 is received within and accommodated by the interior space of shroud 90.

Figure 9D:
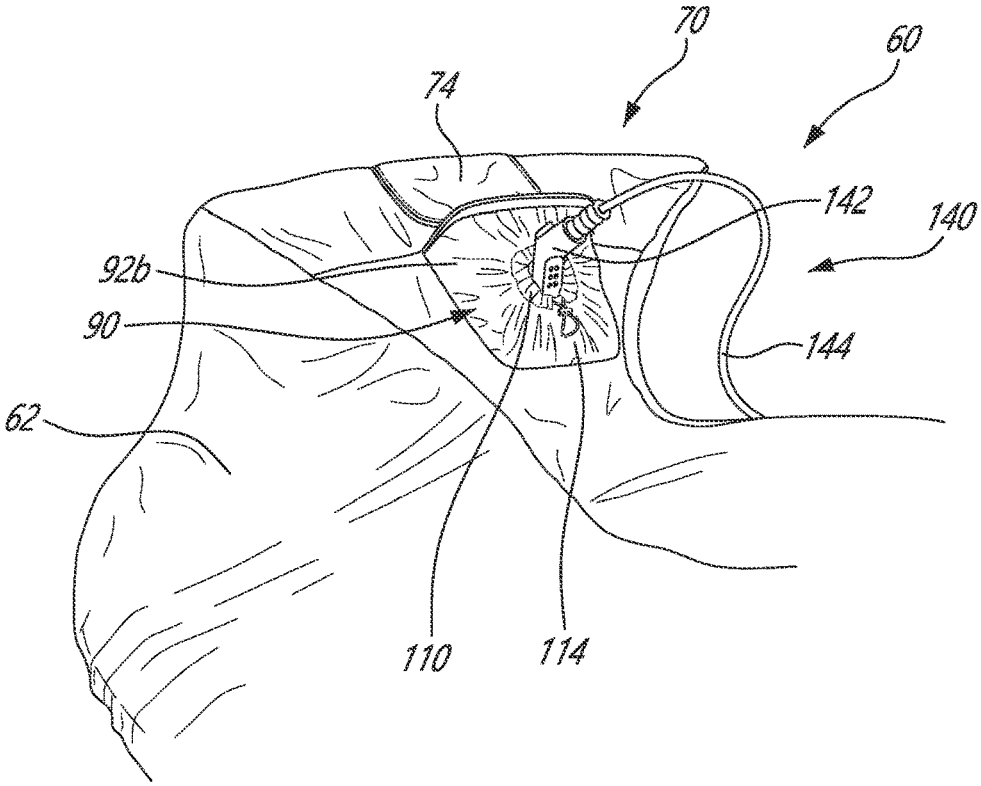

At FIG. 9D, with circular opening 110 in an expanded position, and with access door 52 in an open position to expose charging port 50, a user inserts a charging gun 140 of an external charging system 142 into the interior space of shroud 90 and plugs charging gun 140 into the appropriate one of the DC plug 54 and AC plug 56 of charging port 50. In examples, opposing side panels of shroud 90, such as side panel 92*b*, are made of a transparent material to enable see charging door 52 and charging port 50 when plugging charging head 140 into the appropriate one of the DC plug 54 and AC plug 56.

As illustrated by FIG. 9D, according to examples, after charging gun 140 has been plugged into charging port 50, drawstring 114 can be pulled to constrict circular opening 110 about a perimeter surface of charging gun 140, or around the cables 144 in the case where the entirety of the charging gun 140 is contained within the shroud 90, to form an weather-resistant seal there about to prevent infiltration of contaminants (e.g., water, dust, dirt, oil, etc.) into the interior of protective cover 60 through shroud 90 via opening 110. FIG. 9D illustrates charging gun 140 as being disposed only partially within shroud 90. In other examples, the entirety of charging gun 140 is disposed within shroud 90 such that only charging cables 144 extend through opening 110, wherein opening 110 can be constricted about charging cables 144.

Figure 10A:
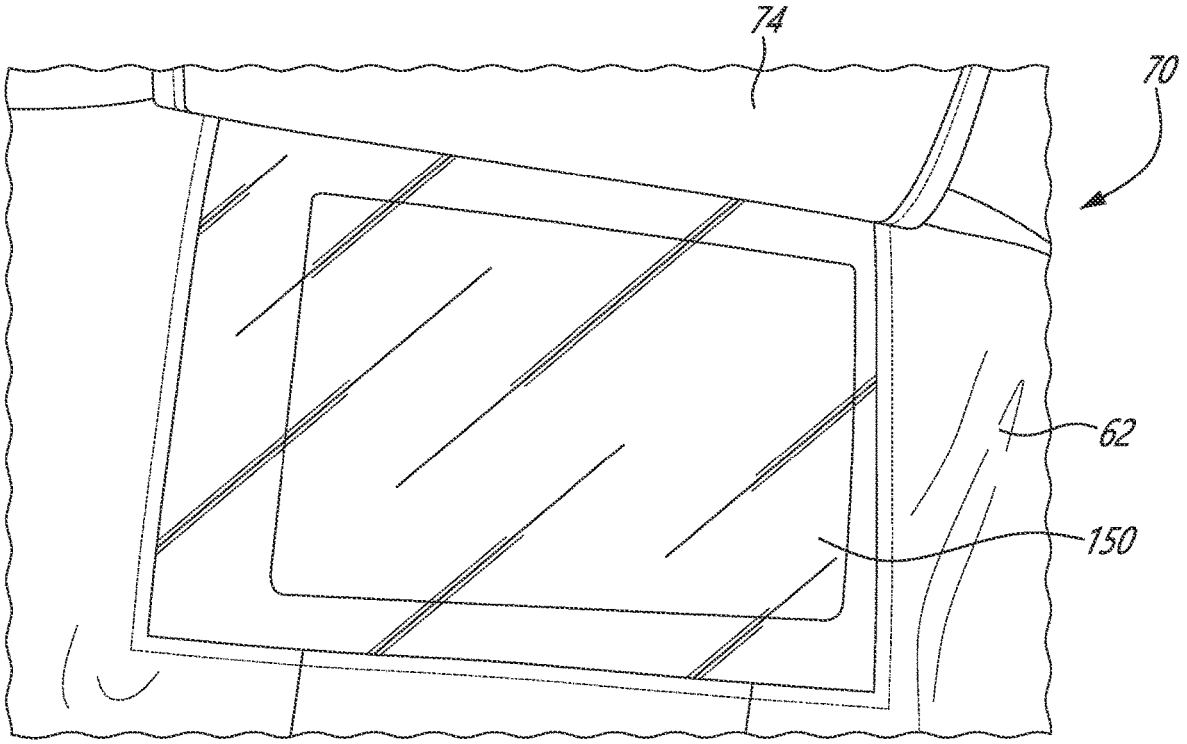
FIG. 10A generally illustrates a portion a charging port access of a removable protective cover for enabling viewing of a control console, according to examples of the present disclosure.
Figure 10B:
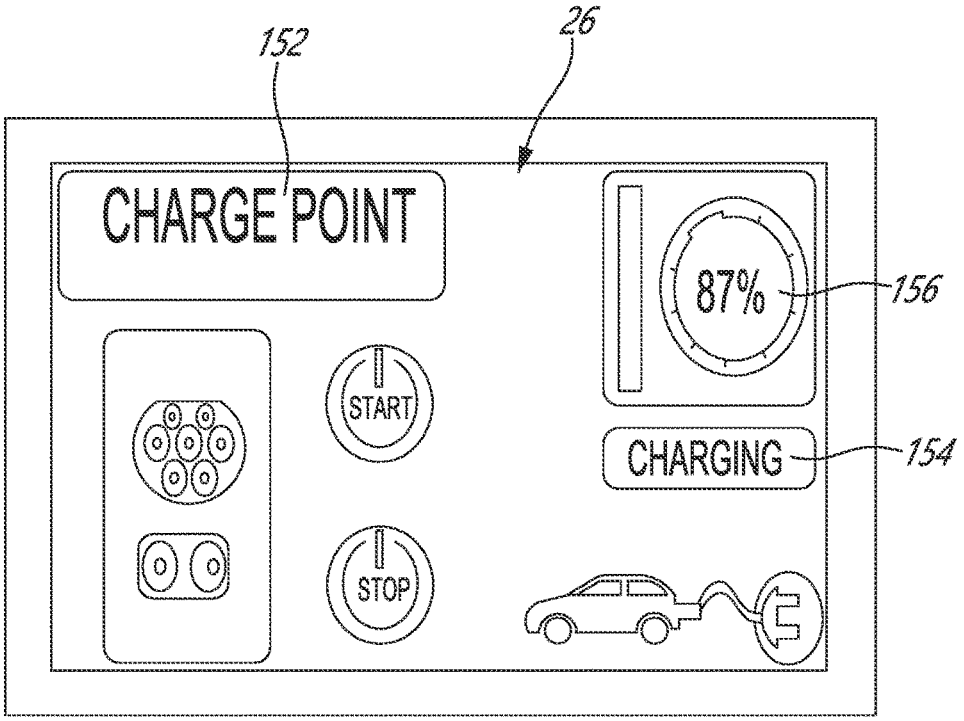
FIG. 10B generally illustrates an example menu screen of a control console viewable through a transparent panel of a charging port access of a removable protective cover, according to examples of the present disclosure.

FIG. 10A is an enlarged view illustrating second flap 74 of charging port access 70 in an open position to expose a clear panel 150 through which display 26 of control console 24 (see FIG. 1A) can be viewed when protective cover 60 is installed on PWC 10, or another electric vehicle. In an alternative embodiment, clear panel 150 is absent such that when second flap 74 is open, direct access to the display 26 is provided. This embodiment may facilitate access to a touch-screen, for example. During charging of battery pack 32 of PWC 10, when charging gun 140 is plugged into charging port 50 (such as illustrated by FIG. 9D), as illustrated by FIG. 10B, display 26 presents a menu screen 152 illustrating various parameters associated with charging of PWC 10, including a charging status indication 154 and a percentage of battery charge indication 156, which is viewable through clear panel 150.

Figure 11A:
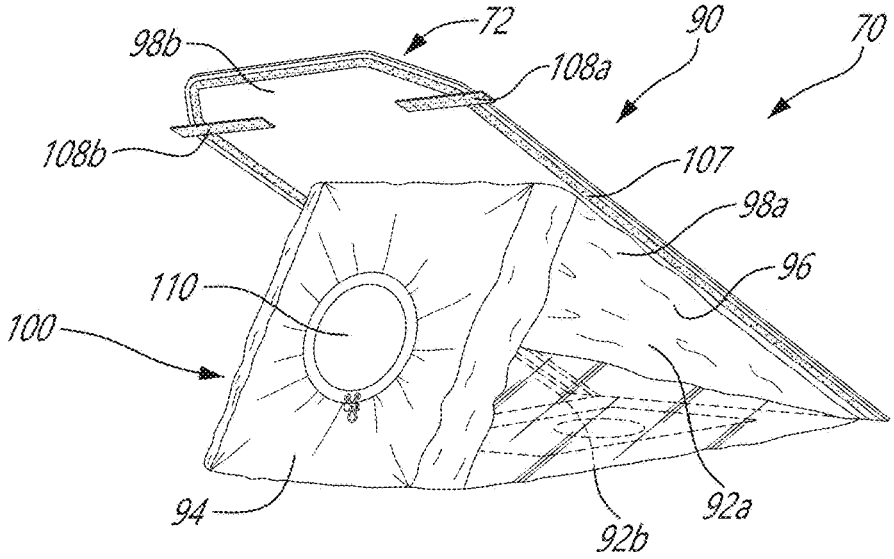
FIGS. 11A-11C are perspective views generally illustrating operation of a charging port access of a removable protective cover, according to examples of the present disclosure.
Figure 11B:
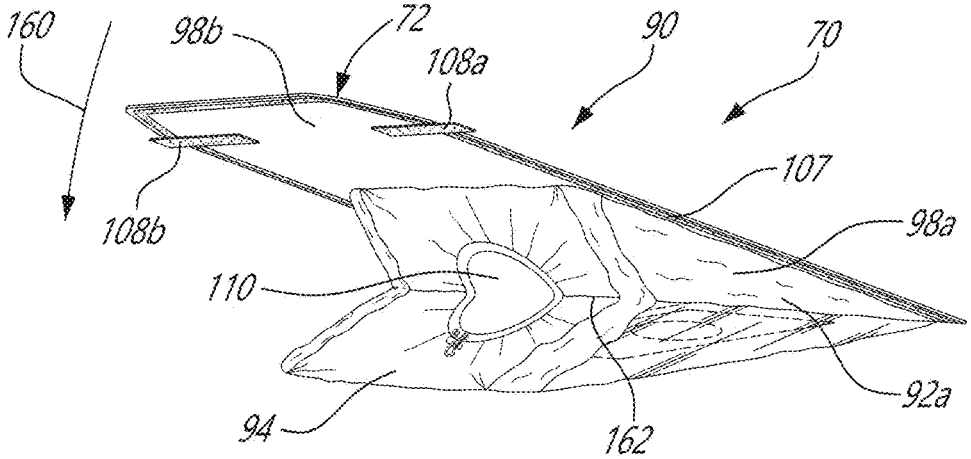
Figure 11C:
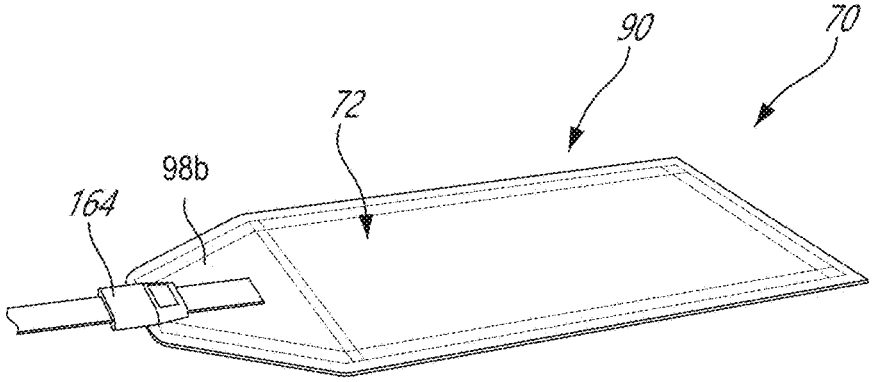

FIGS. 11A-11C show an example of shroud 90 of FIGS. 7A and 7B being transitioned from a deployed position of FIG. 11A to a stowed position of FIG. 11C. FIG. 11A illustrates shroud 90 in a deployed position after removal of charging gun 140 (e.g., see 9D). With reference to FIG. 11B, as first flap 72 is pivoted toward a closed position, as illustrated by directional arrow 160, a crease-line or seam 162 in front panel 94 causes front panel 94 to fold inwardly and opposing sidewalls 92*a*/92*b* to begin folding downward. FIG. 11C illustrates shroud 90 in a stowed position where side panels 92*a* and 92*b* and front panel 94 have been folded down to a flat arrangement and are covered by first flap 72. While a crease-line or seam 162 is possible for improved foldability, in one example, the material of shroud 90 is simply collapsed or scrunched in an uncontrolled manner and positioned underneath first flap 72 within the boundaries of fastener 107. In one example, in addition to fastener 107 (e.g., part of a hook-and-loop system or zip system) securing a perimeter edge of first flap 72 to the exterior surface of main body 62 of protective cover 60, second portion 98*b* of flap 72 extending beyond front panel 94 is secured to main body 62 via a second fastener 164. Second fastener 164 may be a strap and buckle system 164 (or other suitable connecting system). Strap and buckle system 164 ensures that first flap 72 will remain in the closed position under adverse conditions, such as high winds, which might be present when transporting PWC 10 on a trailer, for example.

Figure 12A:
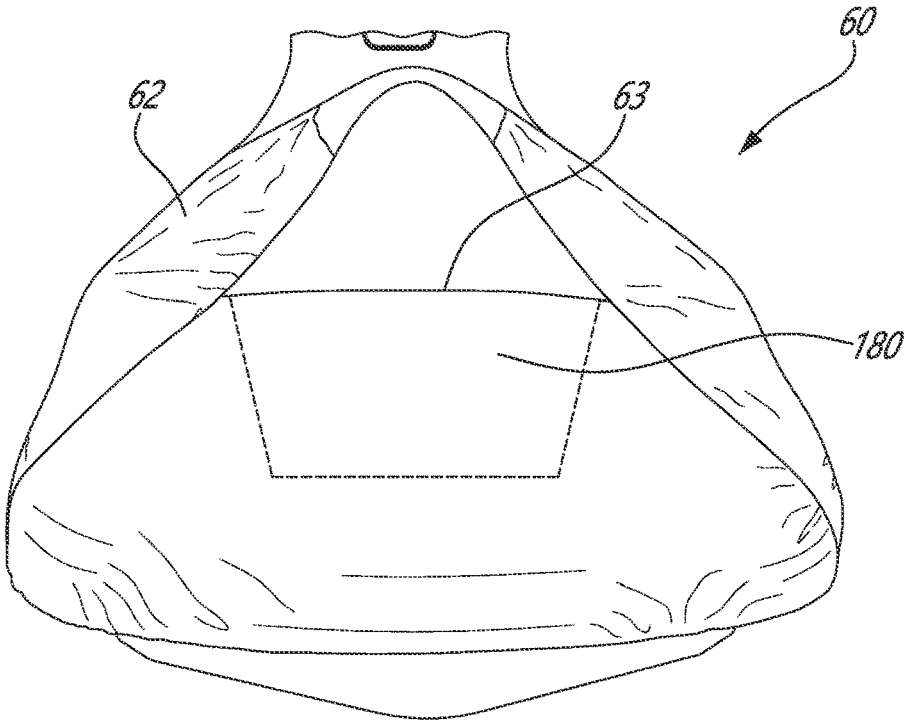
FIG. 12A is a perspective view generally illustrating a rear portion of a protective cover including a built-in storage pouch, in accordance with the present disclosure.
Figure 12B:
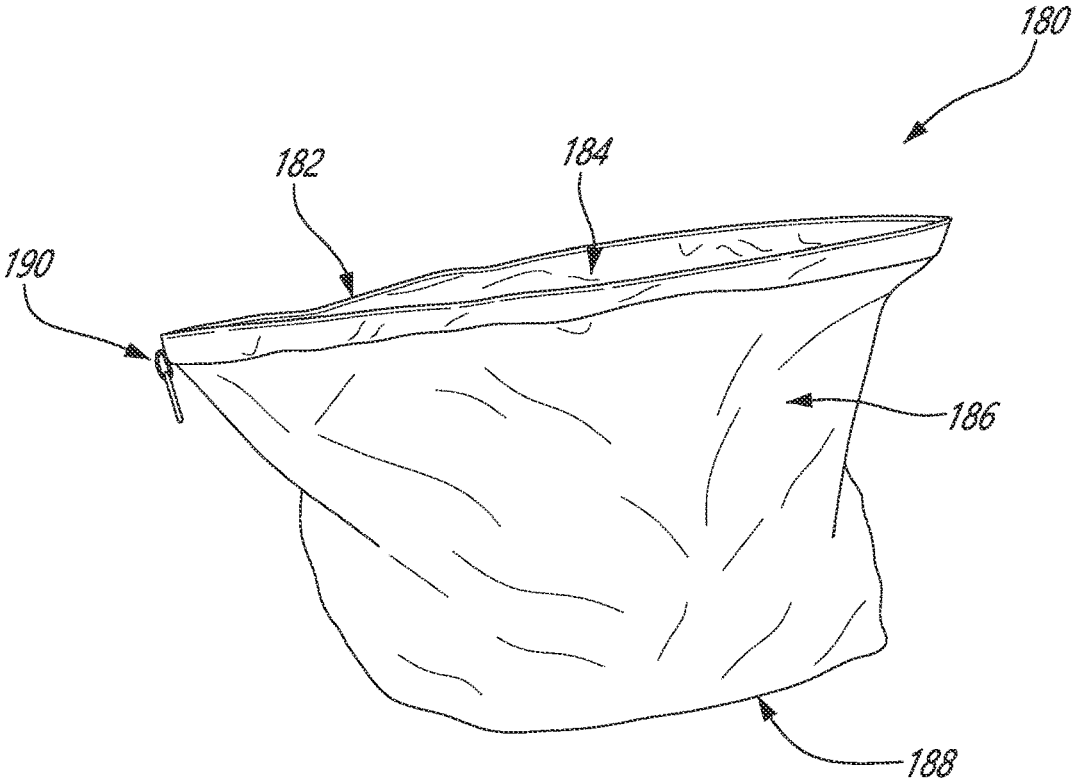
FIG. 12B is a perspective view generally illustrating a built-in storage pouch of the protective cover of FIG. 12A, according to one example of the present disclosure.

FIGS. 12*a* and 12*b* generally illustrate and describe a built-in storage pouch 180 for protective cover 60. FIG. 12*a* represents a rear view of protective cover 60 selectively fitted over PWC 10. In one example, selectively closeable opening 63 extends laterally across a portion of the rear of protective cover 60 and is operable between an open position and a closed position (e.g., via operation of a zipper, snaps, magnets, a hook-loop-system, among other suitable fasteners). When in a closed position, opening 63 forms a seal to prevent material from passing through main body 62.

When in an open position, opening 63 provides access to an interior space of built-in storage pouch 180 which is connected to an interior surface of main body 62 and disposed on an underside of protective cover 60 (as indicated by the dashed lines shown in FIG. 12*a*). In one example, a perimeter of an open (top) end 182 (see FIG. 12*b*) of built-in storage pouch 180 is connected to the interior surface of main body 62 about the perimeter of opening 63 (such connection is not illustrated), such as by sewing, for example (although any suitable attachment technique may be employed). In some examples, built-in storage pouch may be selectively attached to the interior surface of main body 62 (i.e., it may be selectively attached to or removed from main body 62).

In examples, when not fitted over PWC 10, and with opening 63 in the open position, main body 62 of protective cover 60 may be folded or rolled through open end 182 of storage pouch 180 and be scrunched and/or tucked into the interior space of built-in storage pouch 180 for storage. FIG. 12*b* is a perspective view generally illustrating an example of built-in pouch 180 with main body 62 tucked into the interior space 184 thereof, walls 186 of storage pouch 180 form interior space 184 and define open end 182 and opposing closed (or bottom) end 188. In one example, storage pouch 180 includes a closure mechanism 190 to close open end 182 when main body 62 is stowed therein. In one example, as illustrated, closure mechanism 190 comprises a drawstring disposed about a perimeter of open end 182 of built-in pouch 180, but it is noted that any number of suitable closure mechanisms may be employed to close/secure open end 182. In examples, closure mechanism 190 may comprise one or more zippers, snaps or a hook-and-loop closure. In some examples, the closure mechanism 190 may be a double-sided zipper that also provides the closure mechanism for selectively closing opening 63 as well. It is further noted that when protective cover 60 is fitted over PWC 10, built-in storage pouch 180 may be used to store items other than main body 62.

Although protective cover 60 is described and illustrated above primarily with regard to a PWC 10, as noted above, examples of protective covers, in accordance with the present disclosure, may also be adapted for use with other types of electric vehicles, including automotive electric vehicles (e.g. electric cars) and various EPVs such as, for example, snowmobiles, ATVs, UTVs, and electric motorcycles, among other possibilities.

Figure 13:
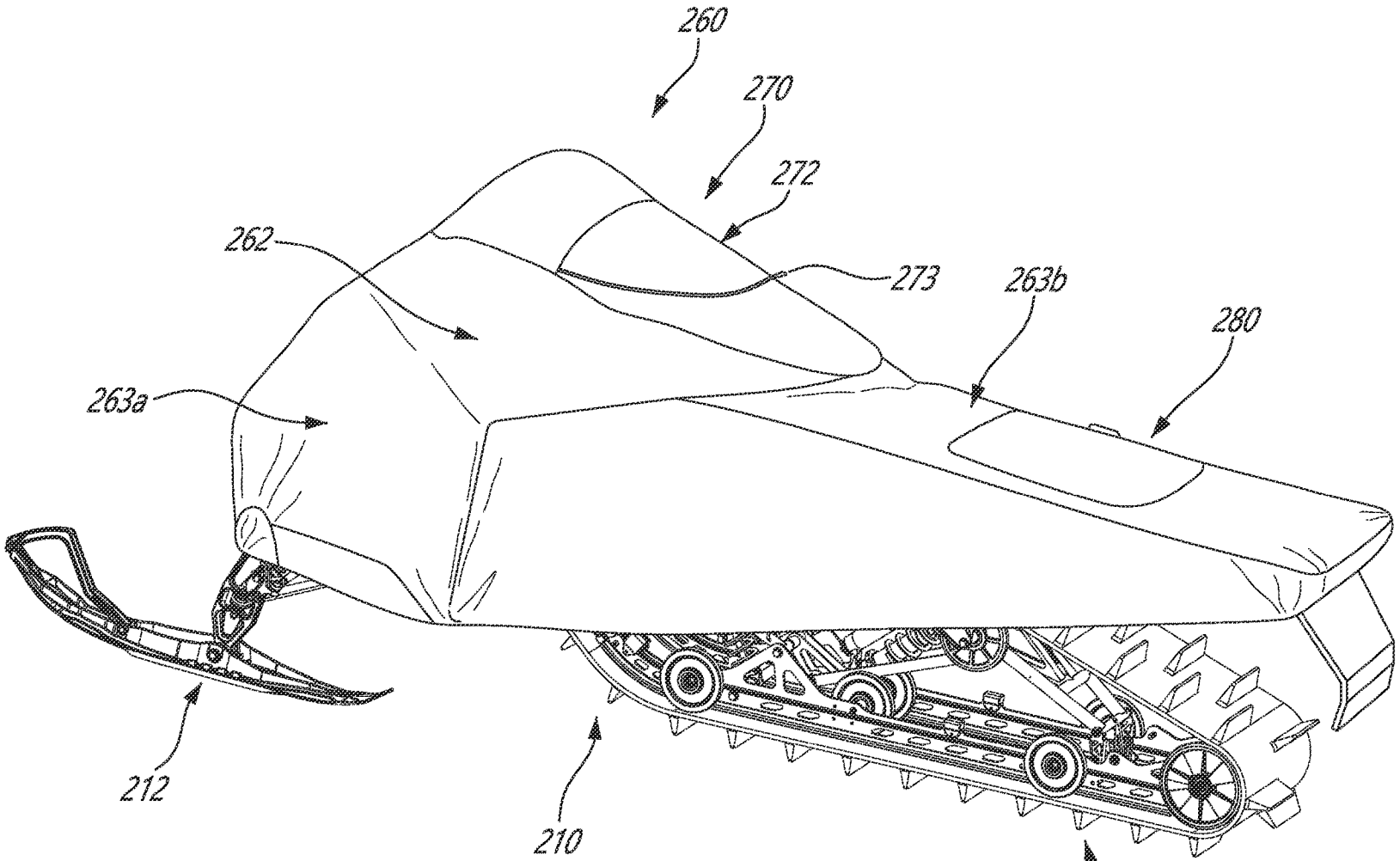
FIG. 13 is a perspective view generally illustrating a removable protective cover including a charging port access, according to examples of the present disclosure.

FIG. 13 is a perspective view that generally illustrates an example of a protective cover 260, in accordance with the present disclosure, which is configured for use with an electric snowmobile 210. As illustrated, a main body 262 of protective cover 260 is selectively fitted over an upper body portion of electric snowmobile 210, with main body 262 including a forward portion 263*a* fitted over a forward portion of electric snowmobile 210 (including, for example, over a front-end cowling or body panels, a windshield, a steering system assembly, a handlebar assembly, a control panel/display, and an electric charging port) supporting front skis 212. A rearward portion 263*b* of main body 262 is fitted over a rearward portion of electric snowmobile 210 (including, for example, over a straddle seat disposed on a tunnel structure) supporting a drive track and suspension assembly 214. In some examples, the main body 262 of the cover 260 may attach to the bottom portion of the electric vehicle, such as via straps, clips, elasticated edges or any other known attachment mechanism.

Additionally, similar to that described above with regard to protective cover 60 for PWC 10, protective cover 260 for electric snowmobile 210 includes a charging port access 270 which is disposed on main body 262 so as to be located proximate to (e.g., aligned with) an electric charging port of electric snowmobile 210 when protective cover 260 is selectively installed thereon. In examples, similar to that described above with regard to charging port access 70, charging port access 270 includes a flap 272 operable between a closed position and an open position to provide access through main body 262 to the electric charging port of electric snowmobile 210 to enable charging thereof with removal of protective cover 260. In one example, when in the closed position, flap 272 is secured to main body 262 using a zipper 273. It is noted that any number of other suitable closing mechanisms may be employed in lieu of zipper 273 such as snaps, magnets, and hook-and-loop systems, for example.

In one example, similar to that illustrated above with respect to protective cover 60, operation of flap 272 between the closed and open positions operates a shroud (similar to shroud 90 described above) between a stowed position and a deployed position to provide a passageway to access the electric charging port of electric snowmobile 210. When in the deployed position, the shroud, via an adjustable opening, is configured to receive at least a portion of a charging gun from an external power source. Although not illustrated, in other examples, protective cover 260 may include a second flap and transparent viewing pane, similar to second flap 72 and transparent viewing pane 150 of protective cover 60) to enable viewing of a display of a control panel of electric snowmobile 210. Additionally, in other examples, protective cover 260 may include a built-in storage pouch 280 (similar to built-in pouch 80 of protective cover 60) for stowing accessories and/or for storing main body 262 when protective cover 260 is not installed on electric snowmobile 210.

Although specific examples have been illustrated and described herein, a variety of alternate and/or equivalent implementations may be substituted for the specific examples shown and described without departing from the scope of the present disclosure. For example, as mentioned above, although a protective cover in accordance with the present disclosure is primarily illustrated and described with respect to a PWC, as well as a snowmobile, it is noted that removable protective cover described herein is suitable for use with other types of electric vehicles, including automotive electric vehicles (e.g. electric cars, vans and trucks) and various EPVs such as, for example, ATVs, UTVs, and electric motorcycles among other possibilities. This application is intended to cover any adaptations or variations of the specific examples discussed herein.

The invention claimed is:

1. A protective cover for an electric vehicle comprising:

a main body to selectively fit over at least an upper portion of the electric vehicle, including over an electric charging port of the electric vehicle, the main body comprising a forward portion for covering at least a portion of a front body panel of the vehicle and a handlebar assembly of the vehicle; and a rearward portion for covering a straddle seat of the vehicle;

a shroud located on the main body so as to be proximate to the charging port when the protective cover is installed on the electric vehicle, the shroud operable between a stowed position and a deployed position, the shroud being substantially flush with the main body when in the stowed position and extending beyond an exterior surface of the main body when in the deployed position, the shroud including an opening accessible when in the deployed position to receive at least a portion of a charging gun through the opening to enable the charging gun to be inserted into the charging port.

2. The protective cover of claim 1, further including:

a flap disposed on the main body, the flap operable between a closed position and an open position, the flap to cover the shroud when in the closed position, and to enable access to the shroud when in the open position.

3. The protective cover of claim 2, wherein the flap forms a portion of the shroud, wherein operating the flap from the closed position to the open position operates the shroud from the stowed position to the deployed position, and operating the flap from the open position to the closed position operates the shroud from the deployed position to the stowed position.

4. The protective cover of claim 3, the shroud being wedge-shaped when in the deployed position and including a pair of substantially triangular opposing side panels, and a front panel extending between the opposing side panels, the opening disposed in the front panel.

5. The protective cover of claim 4, at least one of the opposing side panels being transparent to enable the charging port to be viewed through the shroud so as to provide visual aid to insert the charging gun into the charging port.

6. The protective cover of claim 3, the shroud comprising a longitudinally extending sleeve having a first end coupled to the main body and a second end opposite the first end including the opening.

7. The protective cover of claim 1, wherein the opening is adjustable from a constricted position in the absence of the charging gun to an expanded position to receive the charging gun.

8. The protective cover of claim 1, wherein an entirety of the charging gun is receivable within the shroud via the opening.

9. The protective cover of claim 1, wherein the opening comprises an slit between a pair of adjacent flaps, a zipper being positioned between the pair of adjacent flaps for opening and closing the slit.

10. The protective cover of claim 2, further including a display transparent panel located on the main body to enable viewing of a display panel of a control console of the electrical vehicle when the protective cover is disposed there on.

11. The protective cover of claim 10, further including a second flap operable between a closed position and an open position, the second flap to cover the display transparent panel when in the closed position and to expose the display transparent panel when in the open position to enable viewing of the display panel.

12. A protective cover for an electric vehicle comprising:

a main body to selectively fit over at least an upper portion of the electric vehicle, including over a charging port of the electric vehicle; and a charging port access disposed on the main body so as to be located proximate to the charging port when the protective cover is installed on the electric vehicle, the charging port access including:

a shroud operable between a stowed position and a deployed position, the shroud including an opening extending through the main body accessible when in the deployed position, the opening to receive and enable at least a portion of an electric charging gun to extend through the main body to plug into the electrical charging port; and a flap operable between a closed position and an open position, the flap to cover the shroud and the opening when in the closed position, and to enable access to the opening when in the open position.

13. The protective cover of claim 12, wherein the flap may be secured to the main body in the closed position via a fastening system.

14. The protective cover of claim 13, wherein the fastening system comprises a zipper between the flap and the main body.

15. The protective cover of claim 12, wherein a size of the opening is adjustable between a closed position in the absence of the electric charging gun, and an open position to receive the electric charging gun.

16. The protective cover of claim 15, wherein the opening is adjustable to constrict about the electric charging gun when the electric charging gun is disposed therein.

17. The protective cover of claim 15, wherein the opening comprises a slit formed between a pair of adjacent flaps.

18. The protective cover of claim 17, wherein a zipper is positioned between the pair of adjacent flaps for opening and closing the slit.

19. The protective cover of claim 15, further including a transparent panel adjacent to the opening to enable the charging port to be viewed through the main body.

20. The protective cover of claim 12, further including a second flap operable between a closed position and an open position, the second flap to cover a display transparent panel when in the closed position and to expose the display transparent panel when in the open position to enable viewing of a vehicle display panel.

* * * * *